US009386900B2

(12) United States Patent
Suda et al.

(10) Patent No.: US 9,386,900 B2
(45) Date of Patent: Jul. 12, 2016

(54) CLEANING TOOL

(71) Applicant: UNI-CHARM CORPORATION, Ehime (JP)

(72) Inventors: Tomokazu Suda, Kanonji (JP); Satoshi Hasegawa, Kanonji (JP); Akane Matsuyo, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 0 days.

(21) Appl. No.: 14/766,440

(22) PCT Filed: Jan. 10, 2014

(86) PCT No.: PCT/JP2014/050380

§ 371 (c)(1),
(2) Date: Aug. 6, 2015

(87) PCT Pub. No.: WO2014/122949

PCT Pub. Date: Aug. 14, 2014

(65) Prior Publication Data

US 2015/0366428 A1 Dec. 24, 2015

(30) Foreign Application Priority Data

Feb. 7, 2013 (JP) ..... 2013-022749

(51) Int. Cl.

| | |
|---|---|
| ***A47L 13/20*** | (2006.01) |
| ***A47L 13/38*** | (2006.01) |
| ***A47L 13/46*** | (2006.01) |
| ***A47L 13/256*** | (2006.01) |

(52) U.S. Cl.

CPC ..... *A47L 13/38* (2013.01); *A47L 13/20* (2013.01); *A47L 13/256* (2013.01); *A47L 13/46* (2013.01)

(58) Field of Classification Search

CPC ..... A47L 13/20; A47L 13/38; A47L 13/46; A47L 13/256

See application file for complete search history.

(56) References Cited

U.S. PATENT DOCUMENTS

| | | | | |
|---|---|---|---|---|
| 7,383,602 | B2 * | 6/2008 | Tanaka | A47L 13/24 15/147.2 |
| 7,870,635 | B2 * | 1/2011 | Yamada | A47L 13/18 15/208 |
| 7,937,797 | B2 * | 5/2011 | Tsuchiya | A47L 13/46 15/209.1 |
| 8,156,603 | B2 * | 4/2012 | Tsutanaga | A47L 13/38 15/144.4 |

FOREIGN PATENT DOCUMENTS

JP 2011-41828 A 3/2011

OTHER PUBLICATIONS

International Search Report mailed Mar. 25, 2014 in International Application No. PCT/JP2014/050380.

* cited by examiner

*Primary Examiner* — Randall Chin
(74) *Attorney, Agent, or Firm* — Hauptman Ham, LLP

(57) ABSTRACT

To provide a cleaning tool which, upon attachment of a cleaning body to a cleaning-body holder, feels good to use. The present invention relates to a cleaning tool comprising a holding tool for holding a cleaning sheet. In the present invention, a first extremity virtual line and a second extremity virtual line are formed. The first extremity virtual line is the shortest line linking a center line in the length direction and a first extremity of a holding part. The second extremity virtual line is the shortest line linking the center line in the length direction and a second extremity of a protruded part. The first extremity virtual line is formed so as to be longer than the second extremity virtual line.

22 Claims, 23 Drawing Sheets

CLEANING TOOL

RELATED APPLICATIONS

The present application is a National Phase of International Application Number PCT/JP2014/050380, filed Jan. 10, 2014, and claims priority of Japanese Patent Application No. 2013-022749 filed on Feb. 7, 2013.

TECHNICAL FIELD

The present invention relates to a cleaning tool for cleaning an object to be cleaned. Further, internal applications of PCT/JP2014/051588 and PCT/JP2013/079088 are respectively incorporated by reference.

BACKGROUND ART

Japanese Unexamined Patent Application Publication (JP-A) No. 2011-041828 discloses a cleaning tool having a sheet-type cleaning element and a cleaning element holder for holding the cleaning element. The cleaning element is formed by laminating a plurality of sheets and a fiber assembly. The cleaning element holder has a bifurcated shape having a pair of holding plates. The holding plates are elongate flat plates arranged on the same plane. The cleaning element is held by the cleaning element holder when the holding plates are inserted into the holding space of the cleaning element.

PRIOR ART DOCUMENT

Patent Document

Patent Document 1: JP-A No. 2011-041828

SUMMARY OF THE INVENTION

Problem to be Solved by the Invention

In the cleaning tool disclosed in JP-A No. 2011-041828, the holding plates of the cleaning element holder each have a linear shape and have a projection extending in an outside direction.

When the cleaning element holder is attached to the cleaning element, the holding plates of the cleaning element holder are inserted into the holding space of the cleaning element. At this time, each of the pair holding plates gets into contact with an end of an opening in the holding space and is curved in an inside direction. In the process of insertion, immediately after the projection of the holding plate passes a welding part of the cleaning element, the holding plate is moved in the outside direction from the inwardly curved state. When the holding plate is further inserted and the projection of the holding plate gets into contact with a second welding part, the holding plate is curved in the inside direction again.

Specifically, in the process of attaching the cleaning element holder to the cleaning element, the user feels resistance whenever the projection of the holding plate gets into contact with the welding parts of the cleaning element and passes the welding parts. Therefore, in attaching the cleaning element holder and the cleaning element, the cleaning tool disclosed in JP-A No. 2011-041828 is not so good in feeling of use.

Accordingly, it is an object of the present invention to provide a cleaning tool excellent in feeling of use in attaching the cleaning element holder and the cleaning element.

Means for Solving the Problem

In order to solve the above problem, according to a preferred aspect of the present invention, a cleaning tool having a cleaning sheet and a holder for holding the cleaning sheet is provided. The cleaning tool has a longitudinal direction in which the holder is inserted into the cleaning sheet; a transverse direction crossing the longitudinal direction; a transverse direction center point which is a center point on the cleaning tool in the transverse direction; a longitudinal center line which is a line passing through the transverse direction center point in parallel to the longitudinal direction; an outside direction which is a direction away from the transverse direction center point on the cleaning tool; and an inside direction which is a direction toward the transverse direction center point on the cleaning tool. The cleaning sheet has an insertion part into which the holder is inserted. The holder includes a holding part which is inserted into the insertion part of the cleaning sheet, a first outermost part of the holding part which projects most in the outside direction in the transverse direction, a projection which is formed in the outside direction in the holding part, a second outermost part of the projection which projects most in the outside direction in the transverse direction, and a grip part which is connected to the holding part and designed to be held by a user. A first outermost virtual line which is a shortest line connecting the longitudinal center line and the first outermost part and a second outermost virtual line which is a shortest line connecting the longitudinal center line and the second outermost part are formed, and the first outermost virtual line is longer than the second outermost virtual line.

In a further aspect of the cleaning tool according to the present invention, the holding part includes a connection part connected to the grip part, a tip part on a side opposite to the connection part, and an extending part extending from the connection part toward the tip part, and the first outermost part is provided in the extending part.

In a further aspect of the cleaning tool according to the present invention, the first outermost part is formed at a point bisecting a length of the extending part in the longitudinal direction.

In a further aspect of the cleaning tool according to the present invention, the extending part has a curved shape projecting most at the first outermost part.

In a further aspect of the cleaning tool according to the present invention, the projection includes a first projection formed on the tip part side of the holding part, and a second projection formed on the connection part side of the holding part.

In a further aspect of the cleaning tool according to the present invention, the second outermost part is formed in the first projection.

In a further aspect of the cleaning tool according to the present invention, the cleaning sheet includes a contact sheet which contacts an object to be cleaned when cleaning the object, a holding sheet which is superposed on the contact sheet, and a bonded part by which the contact sheet and the holding sheet are bonded to form the insertion part.

In a further aspect of the cleaning tool according to the present invention, the cleaning tool has an inserting direction parallel to the longitudinal direction and a pulling-out direction opposite to the inserting direction. The projection includes an inserting side region on a front side in the inserting direction, a pulling-out side region on a front side in the pulling-out direction, and an intermediate region between the inserting side region and the pulling-out side region. The projection has an insertion starting point at which the inserting side region first gets into contact with the bonded part when the holder is inserted into the insertion part, an insertion end point at which the contact of the inserting side region with the bonded part terminates when the holder is inserted into the insertion part, a first projection virtual line connecting the insertion starting point and the insertion end point, a second projection virtual line parallel to the inserting direction and passing through the insertion starting point, a first angle made by the first projection virtual line and the second projection virtual line, a pulling-out starting point at which the pulling-out side region first gets into contact with the bonded part when the holder is pulled out of the insertion part, a pulling-out end point at which the contact of the pulling-out side region with the bonded part terminates when the holder is pulled out of the insertion part, a third projection virtual line connecting the pulling-out starting point and the pulling-out end point, a fourth projection virtual line parallel to the pulling-out direction and passing through the pulling-out starting point, and a second angle made by the third projection virtual line and the fourth projection virtual line. The first angle is smaller than the second angle.

In a further aspect of the cleaning tool according to the present invention, a part of the cleaning sheet corresponding to the extending part is thicker than a part of the cleaning sheet corresponding to the connection part in a thickness direction of the cleaning sheet when the holder is inserted into the insertion part and holds the cleaning sheet.

In a further aspect of the cleaning tool according to the present invention, the part of the cleaning sheet corresponding to the extending part is thicker than a part of the cleaning sheet corresponding to the tip part in the thickness direction of the cleaning sheet when the holder is inserted into the insertion part and holds the cleaning sheet.

In a further aspect of the cleaning tool according to the present invention, the insertion part includes an opening into which the holding part is inserted, and an engagement part which has an internal space communicating with the opening and engages with the extending part, and a cross-sectional area of the internal space of the engagement part is larger than a cross-sectional area of the opening in a direction perpendicular to the inserting direction when the holder is inserted into the insertion part and holds the cleaning sheet.

In a further aspect of the cleaning tool according to the present invention, the engagement part has a larger amount of displacement than the opening in the thickness direction of the cleaning sheet.

In a further aspect of the cleaning tool according to the present invention, the opening is formed by bonding the holding sheet to the contact sheet at positions spaced a prescribed distance in a direction parallel to the longitudinal direction of the cleaning sheet, and the engagement part is formed by bonding the holding sheet to the contact sheet at positions spaced a longer distance than said prescribed distance in a direction parallel to the longitudinal direction of the cleaning sheet.

In a further aspect of the cleaning tool according to the present invention, the extending part is formed by two elongate members, and the two elongate members are connected to each other at the connection part.

In a further aspect of the cleaning tool according to the present invention, each of the elongate members comprises two elastically deformable elastic members, and the two elastic members are connected to each other at the connection part side and the tip part side, and are spaced apart from each other in an intermediate region between the connection part and the tip part in the thickness direction when the holder is inserted into the insertion part and holds the cleaning sheet.

In a further aspect of the cleaning tool according to the present invention, the intermediate region includes an intermediate portion located at an equal distance from the connection part and the tip part.

In a further aspect of the cleaning tool according to the present invention, distances between the two elastic members in the thickness direction and in a direction crossing the thickness direction vary in the intermediate region by elastic deformation of the two elastic members.

In a further aspect of the cleaning tool according to the present invention, a maximum distance in the thickness direction between the two elastic members in a state that no external force is applied is 250% or more of a minimum distance in the thickness direction between the two elastic members deformed by an external force.

In a further aspect of the cleaning tool according to the present invention, the cleaning sheet has strips which are formed by a sheet-like member and contiguous to the insertion part and extend in the transverse direction. The insertion part includes a first insertion region formed by a sheet-like member and a second insertion region formed by a sheet-like member. The holding part in the holder has a tension applying part which applies prescribed tension to the second insertion region of the cleaning sheet. When the holding part of the holder is inserted into the insertion part of the cleaning sheet, the tension applying part of the holding part applies tension to the second insertion region of the cleaning sheet so that the second insertion region forms a tension part, and the strips extending in the transverse direction in the tension part are moved in a direction toward the first insertion region.

In a further aspect of the cleaning tool according to the present invention, the tension applying part includes a first tension applying part which applies tension to the first insertion region of the cleaning sheet and a second tension applying part that applies tension to the second insertion region of the cleaning sheet.

In a further aspect of the cleaning tool according to the present invention, the second tension applying part is disposed inward of the first tension applying part in the transverse direction.

In a further aspect of the cleaning tool according to the present invention, the tension part is formed from the second tension applying part to the first tension applying part.

Effect of the Invention

According to the present invention, a cleaning tool excellent in feeling of use in attaching the cleaning element holder and the cleaning element can be provided.

BEST MODES FOR CARRYING OUT THE INVENTION (Outline of Cleaning Tool)

A first embodiment of the present invention is now described with reference to FIGS. 1 to 11. A structure of a cleaning tool 100 as one embodiment of a "cleaning tool" according to the present invention is now explained. Objects to be cleaned by using the cleaning tool 100 typically include surfaces to be cleaned (floors, walls, windows, ceilings, external walls, furniture, clothes, curtains, bedding, lighting, home electric appliances, etc.) inside and outside of houses, apartments, buildings, factories, vehicles, etc. and surfaces of human body parts to be cleaned. The surfaces to be cleaned may be either flat or curved, uneven or stepped.

Figure 1:
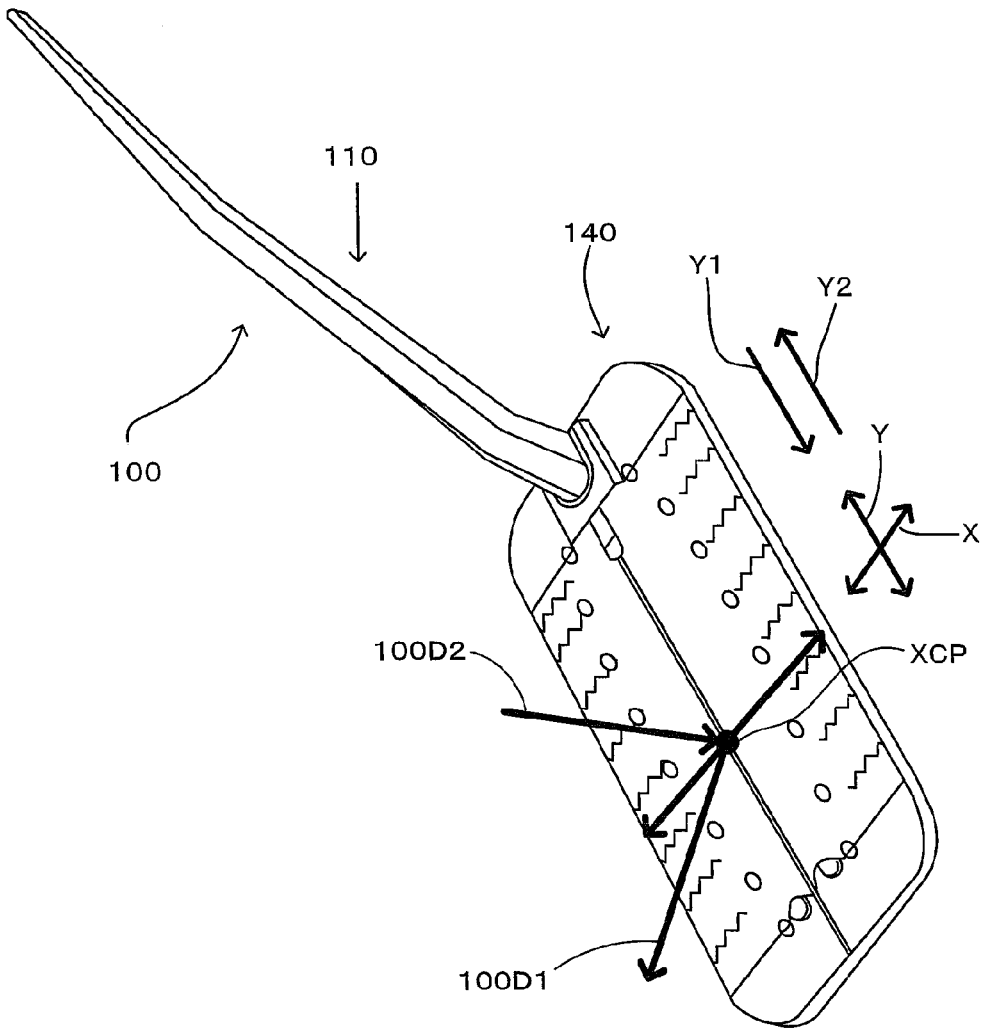
FIG. 1 is a perspective view showing an overall structure of a cleaning tool according to a first embodiment of the present invention.

As shown in FIG. 1, the cleaning tool 100 includes a cleaning element holder 110 and a cleaning element 140. The cleaning element holder 110 is configured to be removably attached to the cleaning element 140 and to hold the cleaning element 140. The cleaning tool 100, the cleaning element holder 110 and the cleaning element 140 are example embodiments that correspond to the "cleaning tool", the "holder" and the "cleaning sheet", respectively, according to this invention.

The cleaning tool 100 has a longitudinal direction Y and a transverse direction X crossing the longitudinal direction Y. The longitudinal direction Y is perpendicular to the transverse direction X.

The longitudinal direction Y is parallel to an inserting direction Y1 in which the cleaning element holder 110 is attached to the cleaning element 140 and to a pulling-out direction Y2 in which the cleaning element holder 110 is pulled out of the cleaning element 140. The longitudinal direction Y, the transverse direction X, the inserting direction Y1 and the pulling-out direction Y2 are example embodiments that correspond to the "longitudinal direction", the "transverse direction", the "inserting direction" and the "pulling-out direction", respectively, according to this invention.

The cleaning tool 100 has a transverse direction center point XCP which is a center point on the cleaning tool 100 in the transverse direction X. The transverse direction center point XCP can be formed on a line passing through any point on the cleaning tool 100 in the transverse direction X.

The cleaning tool 100 further has a longitudinal center line YCL which is a line passing through the transverse direction center point XCP in parallel to the longitudinal direction Y. The transverse direction center point XCP and the longitudinal center line YCL are example embodiments that correspond to the "transverse direction center point" and the "longitudinal center line", respectively, according to this invention.

The cleaning tool 100 further has an outside direction 100D1 which is a direction away from the transverse direction center point XCP on the cleaning tool 100, and an inside direction 100D2 which is a direction toward the transverse direction center point XCP on the cleaning tool 100. The outside direction 100D1 and the inside direction 100D2 are example embodiments that correspond to the "outside direction" and the "inside direction", respectively, according to this invention.

(Structure of the Cleaning Element Holder)

Figure 2:
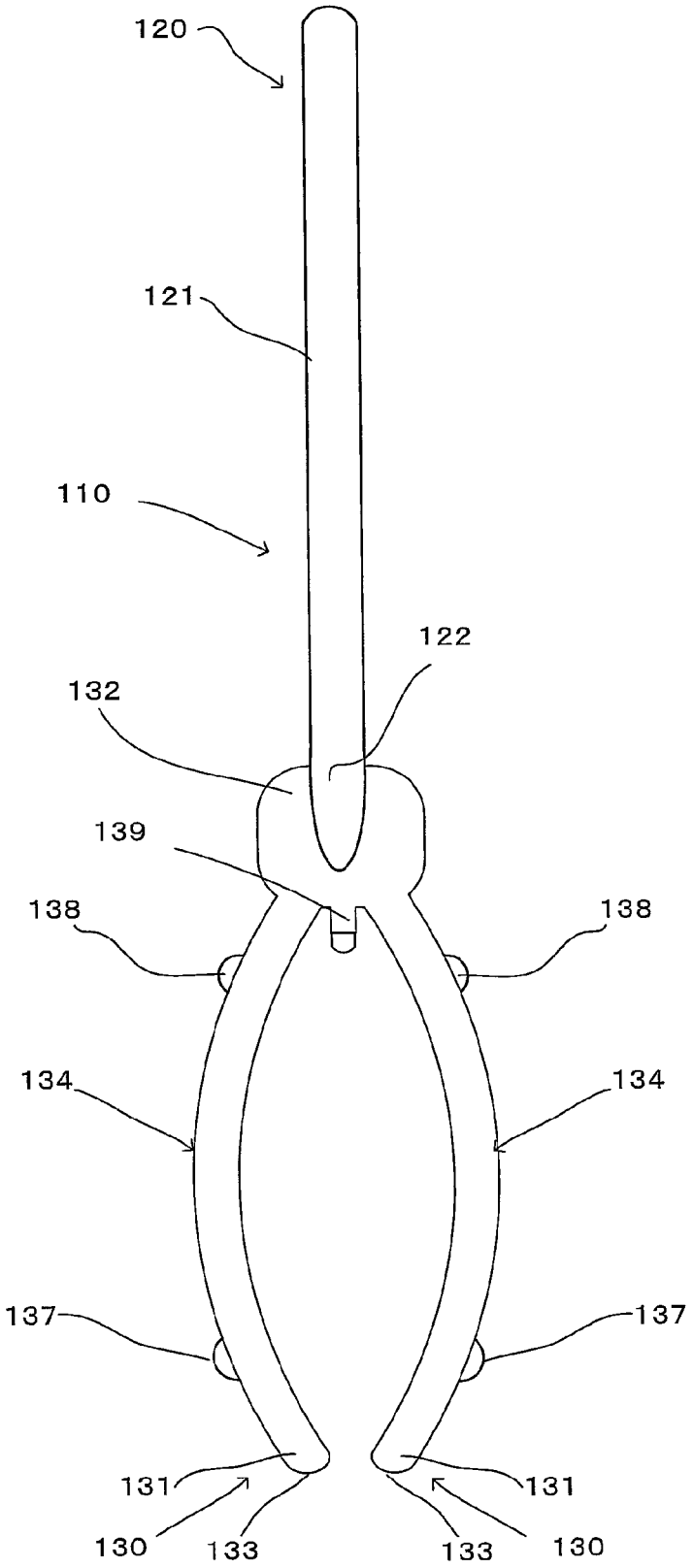
FIG. 2 is a plan view of the cleaning element holder.
Figure 3:
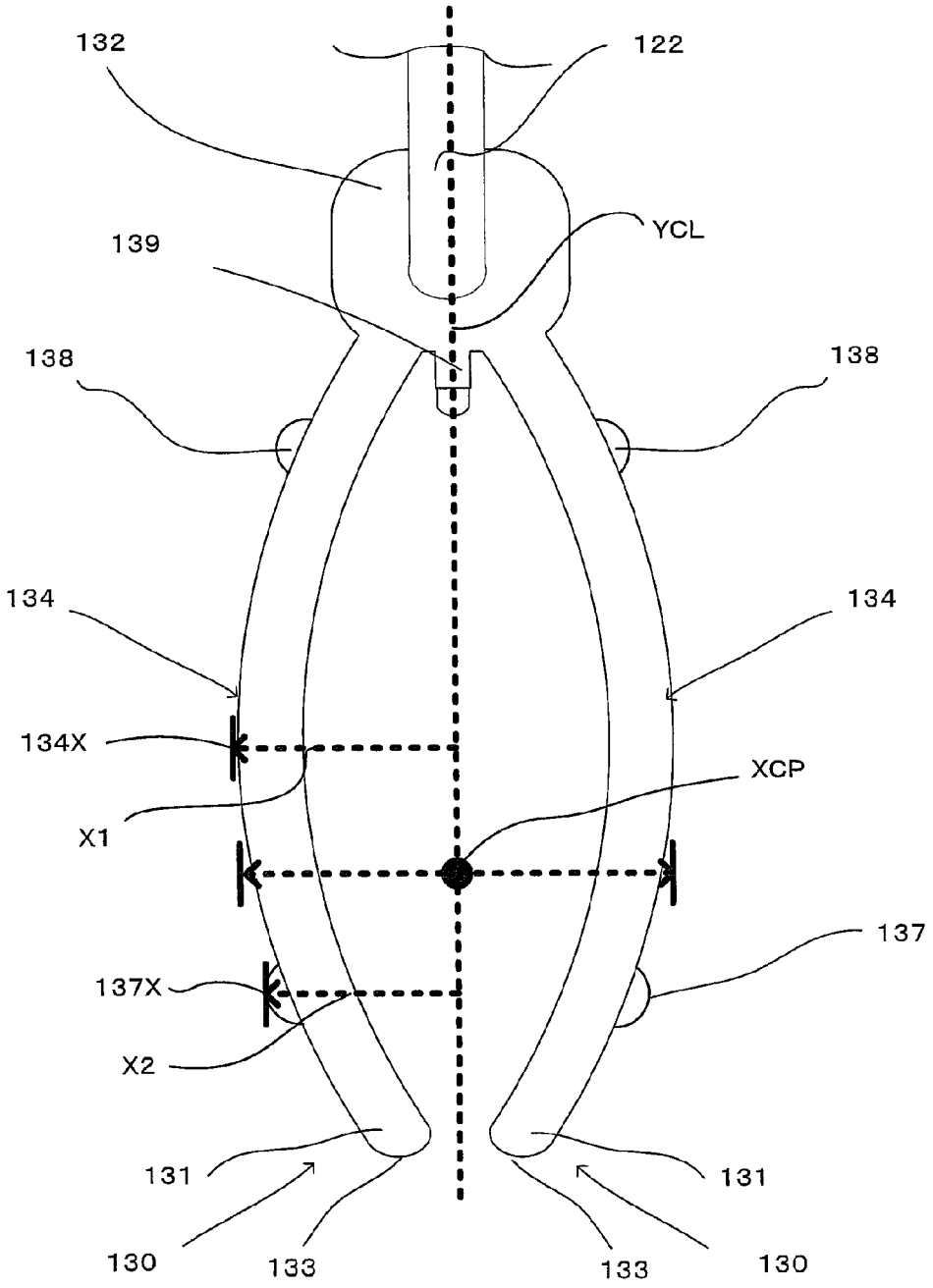
FIG. 3 is an explanatory drawing of the cleaning element holder.

As shown in FIGS. 2 and 3, the cleaning element holder 110 mainly includes a handle part 120 and a cleaning element holding part 130. The handle part 120 is an elongate member to be held by a user during cleaning. The handle part 120 has a handle 121 and a connecting part 122. The connecting part 122 is connected to a base part 132 of the cleaning element holding part 130. The handle 121 extends in an elongate form from the connecting part 122. The handle part 120 is an example embodiment that corresponds to the "grip part" according to this invention. For convenience of explanation, the upper side and the lower side in FIG. 2 are referred to as the right side and the left side of the cleaning element holder 110, respectively.

The cleaning element holding part 130 is a member formed of resin material and configured to hold the cleaning element 140. The cleaning element holding part 130 mainly includes a pair of elongate holding members 131, projections 137, 138 and a retaining plate 139.

Specifically, polypropylene (PP) is used to form the cleaning element holding part 130. Flexible resin materials, such as polyethylene (PE), polyethylene terephthalate (PET), acrylonitrile butadiene styrene (ABS) and thermoplastic polyester elastomer, can be appropriately selected for the cleaning element holding part 130.

The cleaning element holding part 130 and the projections 137, 138 are example embodiments that correspond to the "holding part" and the "projection", respectively, according to this invention.

Each of the holding members 131 extends in a direction opposite to the direction in which the handle 121 extends from the base part 132. Specifically, the holding member 131 has the base part 132, a tip part 133 and an intermediate part 134 extending from the base part 132 to the tip part 133. The tip part 133 of the holding member 131 is a free end.

The base part 132, the tip part 133 and the intermediate part 134 are example embodiments that correspond to the "connection part", the "tip part" and the "extending part", respectively, according to this invention.

The intermediate part 134 is convexly curved in the outside direction 100D1 with respect to the base part 132 and the tip part 133. Thus, the holding member 131 has a curved shape having the intermediate part 134 convexly curved in the outside direction 100D1.

The projection 137 is formed on the tip part 133 side of the holding member 131 and hereinafter referred to as a first projection 137, while the projection 138 is formed on the base part 132 side of the holding member 131 and hereinafter referred to as a second projection 138. The first projection 137 and the second projection 138 are example embodiments that correspond to the "first projection" and the "second projection", respectively, according to this invention.

The retaining plate 139 protrudes from the base part 132 and extends parallel to the pair holding members 131 therebetween. The retaining plate 139 is configured as a plate-like member convexly curved downward, and further has an engagement lug (not shown) on the underside.

As shown in FIG. 3, a part of the holding member 131 which projects most in the outside direction 100D in the transverse direction X is defined as a first outermost part 134X. The first outermost part 134X is formed in an intermediate part 134 of the holding member 131, and particularly at a point bisecting the length of the intermediate part 134 in the longitudinal direction Y. Thus, the intermediate part 134 has a curved shape projecting most at the first outermost part 134X.

A part of the first projection 137 which projects most in the outside direction 100D in the transverse direction X is defined as a second outermost part 137X.

The first outermost part 134X and the second outermost part 137X are example embodiments that correspond to the "first outermost part" and the "second outermost part", respectively, according to this invention.

A shortest line connecting the longitudinal center line YCL and the first outermost part 134X is defined as a first outermost virtual line X1.

A shortest line connecting the longitudinal center line YCL and the second outermost part 137X is defined as a second outermost virtual line X2.

The first outermost virtual line X1 and the second outermost virtual line X2 are example embodiments that correspond to the "first outermost virtual line" and the "second outermost virtual line", respectively, according to this invention.

The first outermost virtual line X1 is longer than the second outermost virtual line X2. By provision of this structure, the cleaning element holder provides the effects which are described below.

(Structure of the Cleaning Element)

Figure 5:
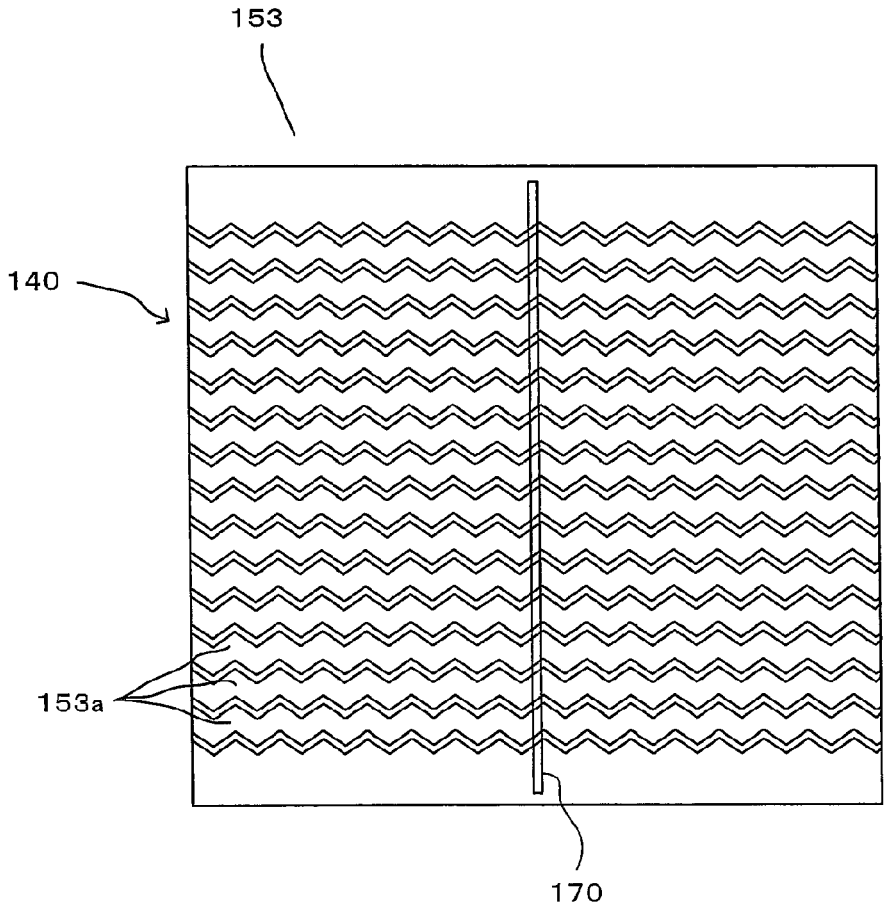
FIG. 5 is a plan view of the cleaning element as viewed from a cleaning surface side.
Figure 6:
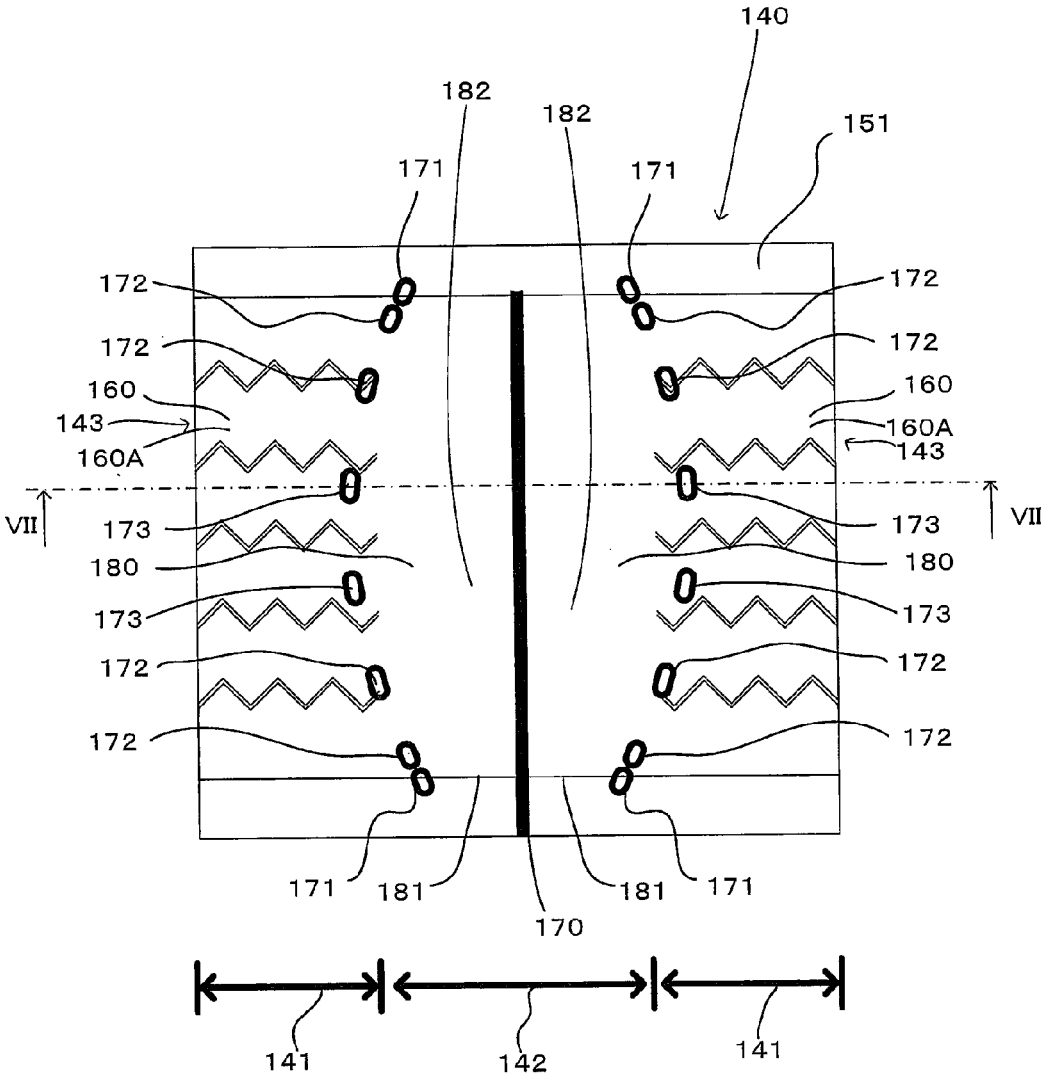
FIG. 6 is a plan view of the cleaning element as viewed from a holding surface side.

The cleaning element 140 is now explained with reference to FIGS. 4 to 7. The cleaning element 140 has a sheet-like form and has a scraping-off function of scraping off dirt on a surface of an object to be cleaned in wipe cleaning. As shown in FIGS. 5 and 6, the cleaning element 140 is rectangular in plan view. The long side direction of the cleaning element 140 substantially coincides with a direction crossing the extending direction of the fibers of the fiber assembly.

Figure 4:
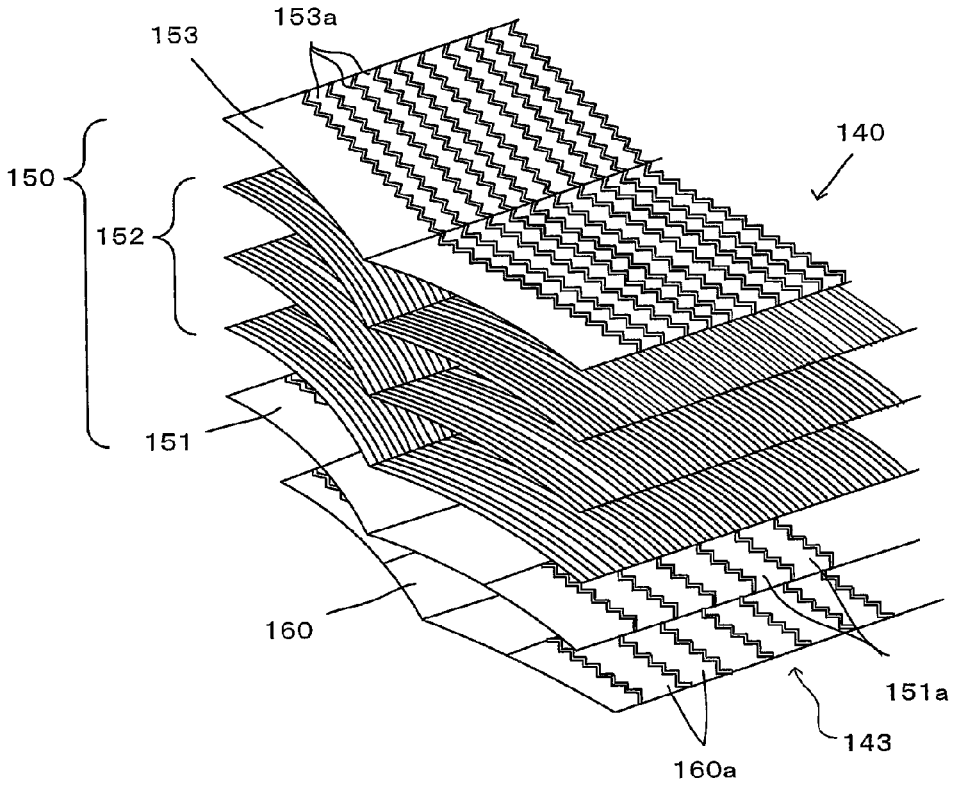
FIG. 4 is an exploded perspective view showing each component of a cleaning element.

As shown in FIG. 4, the cleaning element 140 mainly includes a cleaning element body 150 and a holding sheet 160. The cleaning element 140 may be of disposable type designed for single use, disposable type designed for multiple use which can be used several times, while holding dust or dirt collected from the cleaning surface to be cleaned, or reusable type which can be reused by washing.

The cleaning element body 150 includes a base sheet 151, a fiber assembly 152 and a cleaning side sheet 153 which all have a sheet-like form and are superposed and bonded together. The base sheet 151, the fiber assembly 152 and the cleaning side sheet 153 have the same rectangular shape in plan view, extending in an elongate form in the long side direction of the cleaning element 140. The fiber assembly 152 and the cleaning side sheet 153 form a brush-like part having a dirt scraping-off function, which is also referred to as a "brush part".

As shown in FIG. 4, the base sheet 151 and the cleaning side sheet 153 are rectangular nonwoven fabric sheets. The base sheet 151 has a plurality of zigzag strips 151*a* extending side by side in a short side direction of the cleaning element 140. Further, the cleaning side sheet 153 has a plurality of zigzag strips 153*a* extending side by side in the short side direction of the cleaning element 140. The strips 153*a* are narrower than the strips 151*a* and thus have a lower bending rigidity.

As shown in FIG. 4, the fiber assembly 152 is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 152 contains thermoplastic fibers in part and can be fusion bonded (or welded). The fibers forming the fiber assembly 152 are components of yarn, textile or the like and are thin and flexible fibers having a substantially longer length compared with the thickness. Typically, a long continuous fiber is defined as a filament and a short fiber as a staple.

The fibers of the fiber assembly 152 are bonded on the base end side at a center welding line 170 and welding parts 171, 172, 173, and extend in am elongate form in the short side direction of the cleaning element 140 (or the fiber assembly 152) with the welding parts as a fixed end and its opposite side (tip side) as a free end. The fiber assembly 152 is also referred to as the "fiber bundle" having a plurality of fibers in a bundle. Further, the welding parts 171, 172, 173 form a holding space 180 as described below.

The welding parts 171, 172, 173 are an example embodiment that corresponds to the "bonded part" according to this invention.

The fiber assembly 152 is formed by three fiber layers, but the number of fiber layers may be one or more other than three as necessary. Preferably, the fiber assembly 152 has a planar structure having a predetermined flat or curved surface and has a three-dimensional form having a certain thickness or has a thin sheet-like form. The fiber assembly 152 is typically formed of polyethylene (PE), polypropylene (PP), polyethylene terephthalate (PET), nylon, rayon or the like. In practical use, an assembly of filaments formed by opening a tow is preferably used as the fiber assembly 152. It is particularly preferable that the fiber assembly 152 comprises conjugated fibers having a core of polypropylene (PP) or polyethylene terephthalate (PET) and a core covering sheath of polyethylene (PE). Further, the fibers 110SF of the fiber assembly 152 preferably have a fineness of 1 to 50 dtex, or more preferably 2 to 10 dtex. Each fiber assembly may contain fibers of substantially the same fineness, or it may contain fibers of different finenesses.

Further, in order to enhance the sweeping-out function, it is preferred to use the fiber assembly including the fibers having higher rigidity or the fibers having higher fineness. It is further preferred that the fiber assembly has crimped fibers. Here, the crimped fibers are fibers subjected to a prescribed crimping process and easily intertwined with each other. By provision of the crimped fibers, the fiber assembly becomes bulkier than before the cleaning element holder is attached to the cleaning element, and dust can be easily captured by the crimped portions. This structure can be realized especially by using crimped fibers opened from tows.

The cleaning element 140 has strips 143.

As shown in FIG. 6, the holding sheet 160 is a rectangular nonwoven fabric sheet which is shorter than the base sheet 151 in the long side direction of the cleaning element 140. The holding sheet 160 has a plurality of zigzag strips 160*a* extending side by side in the short side direction (the transverse direction X) of the cleaning element 140. The base sheet 151 has a plurality of zigzag strips 151*a* extending side by side in the short side direction (the transverse direction X) of the cleaning element 140.

Specifically, the strips 143 of the cleaning element 140 include the strips 160*a* of the holding sheet 160 and the strips 151*a* of the base sheet 151. It is sufficient for the cleaning element 140 to have the strips 143. In other words, the strips 143 of the cleaning element 140 may consist of only either the strips 160*a* of the holding sheet 160 or the strips 151*a* of the base sheet 151.

The strips 143, 160*a*, 151*a* are an example embodiment that corresponds to the "strips" according to this invention.

The strips 143 have the same length in the transverse direction X.

A region of the cleaning element 140 which has the strips 143 and extends in the longitudinal direction Y is defined as a first cleaning element region 141. A region of the cleaning element 140 which has no strips 143 and extends in the longitudinal direction Y is defined as a second cleaning element region 142.

The first cleaning element region 141 and the second cleaning element region 142 are example embodiments that correspond to the "first cleaning element region" and the "second cleaning element region", respectively, according to this invention.

The first cleaning element region 141 is provided on each end region of the cleaning element 140 in the transverse direction X, and the second cleaning element region 142 is provided between the pair first cleaning element regions 141.

The first cleaning element region 141 may be provided as a region including only one of the end regions of the cleaning element 140 in the transverse direction X.

The base sheet 151, the cleaning side sheet 153 and the holding sheet 160 are typically formed of sheet-like nonwoven fabric comprising thermal melting fibers (thermoplastic fibers). Therefore, the base sheet 151, the cleaning side sheet 153 and the holding sheet 160 are also referred to as "nonwoven fabric sheet". In order to enhance the sweeping-out function during cleaning, it is preferred to use the nonwoven fabric having higher rigidity. Further, by providing zigzag strips in the sheets, a structure having an excellent cleaning function which can easily catch and capture dust or dirt can be realized. The strips may have a single kind or plural kinds of shapes appropriately selected from various shapes, such as zigzag, linear and curved shapes.

Figure 7:
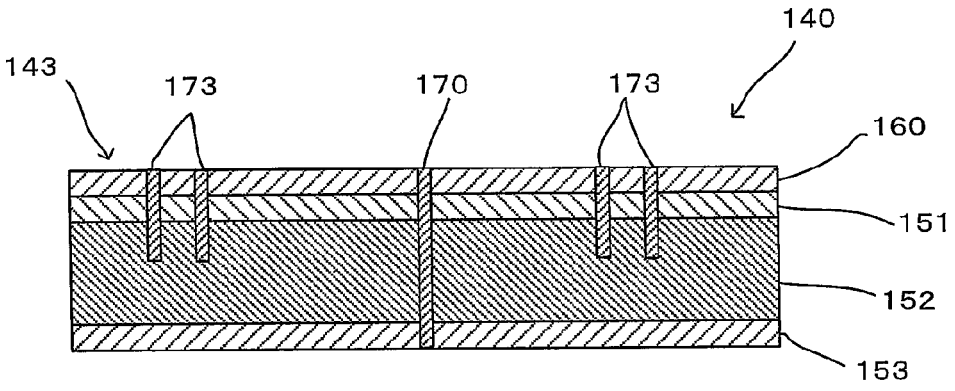
FIG. 7 is a sectional view taken along line VII-VII in FIG. 6

As shown in FIG. 6, the cleaning element body 150 and the holding sheet 160 are welded at the center welding line 170 extending in the long side direction of the cleaning element 140 through a center of the cleaning element 140, and at a plurality of the circular welding parts 171, 172, 173 arranged on the both sides of the center welding line 170. Specifically, as shown in FIG. 7, the base sheet 151, the fiber assembly 152 and the cleaning side sheet 153 which form the cleaning element body 150, and the holding sheet 160 are welded at the center welding line 170. Further, the base sheet 151 and part of the fiber assembly 152 of the cleaning element body 150 and the holding sheet 160 are welded at the welding parts 171, 172, 173.

By welding the sheets as described above, a pair of holding spaces 180 are formed between the center welding line 170 and the welding parts 171, 172, 173 and extend in the long side direction of the cleaning element 140. Each of the holding spaces 180 has openings 181 on the both ends in the long side direction of the cleaning element 140. The holding space 180 is an example embodiment that corresponds to the "insertion part" according to this invention.

In other words, the holding spaces 180 are defined by a prescribed region of the holding sheet 160 and a prescribed region of the base sheet 151 which extend between the pair welding parts 171, 172, 173. A prescribed region of the holding sheet 160 which is located on the upper side (on the upper side as viewed in FIG. 3) of the cleaning tool 100 in the holding space 180 is defined as a first insertion region 180A. A prescribed region of the base sheet 151 which is located on the lower side (on the lower side as viewed in FIG. 3) of the cleaning tool 100 in the holding space 180 is defined as a second insertion region 180B. The first insertion region 180A and the second insertion region 180B are example embodiments that correspond to the "first insertion region" and the "second insertion region", respectively, according to this invention.

The welding parts 171, 172, 173 are arranged on a curve in the long side direction of the cleaning element 140. Specifically, the welding parts 171 on the opening 181 side are arranged closer to the center welding line 170 in the short side direction of the cleaning element 140. The welding parts 172 are arranged in an intermediate region 182 between the openings 181 formed on the both ends in the long side direction of the cleaning element 140, and arranged further away from the center welding line 170 than the welding parts 171. The welding parts 173 are arranged even further away from the center welding line 170. Thus, the holding space 180 is configured such that the cross-sectional area of the intermediate region 182 is larger than that of the opening 181 in the short side direction of the cleaning element 140. In other words, the holding space 180 is configured to have a larger amount of displacement in the intermediate region 182 than in the opening 181 in the thickness direction of the cleaning element 140.

The welding parts 171 are arranged on a boundary between the holding sheet 160 and the base sheet 151. The welding parts 172 are arranged on a boundary between the first cleaning element region 141 and the second cleaning element region 142 in the cleaning element 140. The welding parts 173 are arranged within the first cleaning element region 141.

(Engagement of the Cleaning Element Holder and the Cleaning Element)

Figure 8:
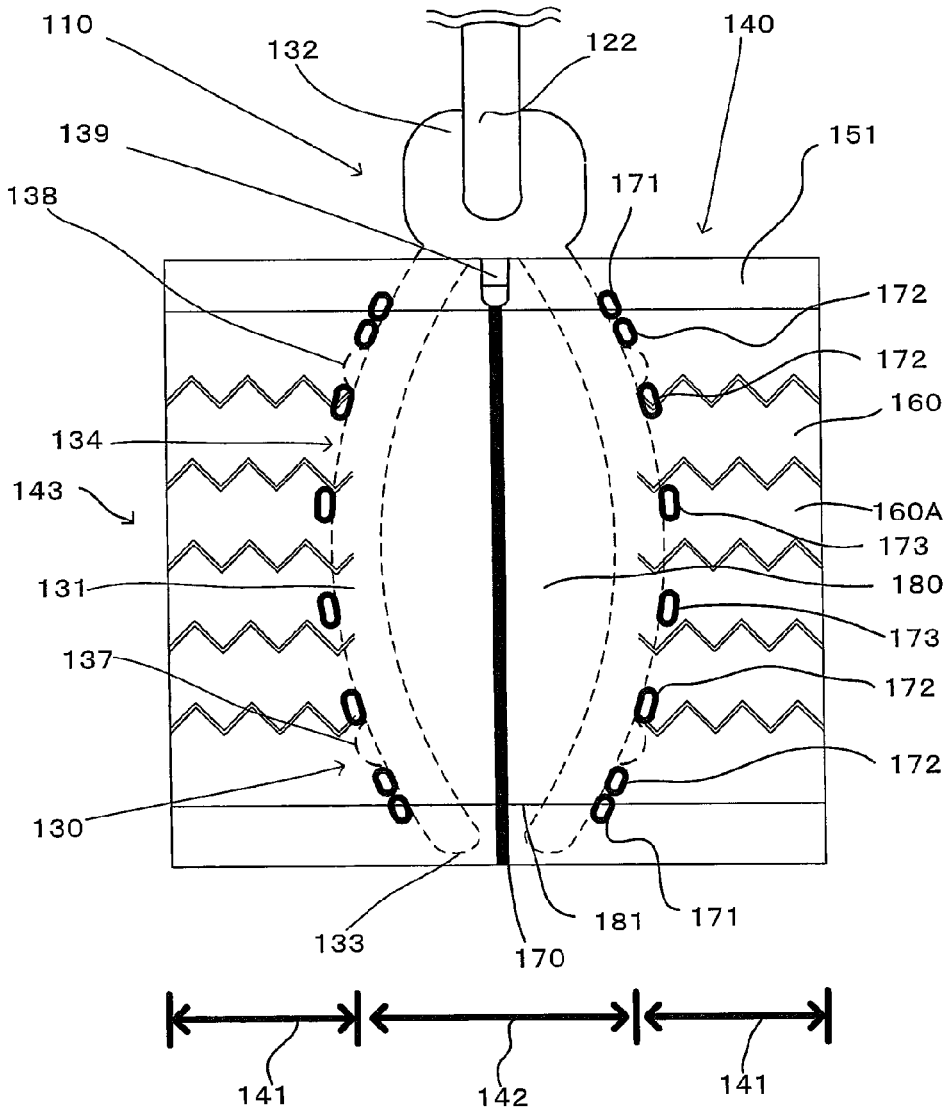
FIG. 8 is a drawing for showing engagement of the cleaning element holder with the cleaning element.

Engagement of the cleaning element holder 110 and the cleaning element 140 is explained with reference to FIG. 8. As shown in FIG. 8, the holding members 131 can be inserted into the holding spaces 180. The cleaning element 140 is held by the cleaning element holder 110 by inserting the holding members 131 into the holding spaces 180.

With the cleaning element 140 held by the cleaning element holder 110, the holding member 131 extend over the first cleaning element region 141 and the second cleaning element region 142 in the transverse direction X.

Specifically, an end region of the holding member 131 adjacent to the base part 132 and the tip part 133 are arranged in the second cleaning element region 142. In the intermediate part 134 of the holding member 131, particularly a region having the first outermost part 134X is arranged in the first cleaning element region 141.

As a result, with the cleaning element 140 held by the cleaning element holder 110, the strips 143 can be made different in length in the transverse direction X. Specifically, in the region in which the holding member 131 is located in the second cleaning element region 142, the length of the strips 143 in the transverse direction X is equal to the original length of the strips 143 formed in the cleaning element 140 in the transverse direction X. In the region in which the holding member 131 is located in the first cleaning element region 141, the length of the strips 143 in the transverse direction X is shorter than the original length of the strips 143 formed in the cleaning element 140 in the transverse direction X.

Therefore, the strips 143 formed in a region of the cleaning element 140 corresponding to the first outermost part 134X of the holding member 131 can be provided with higher rigidity than the strips 143 formed in the other region of the holding member 131.

The intermediate part 134 of the holding member 131 has a curved shape projecting most at the first outermost part 134X. Therefore, with the cleaning element 140 held by the cleaning element holder 110, the rigidity of the strips 143 can be gradually increased from the end region of the intermediate part 134 toward the first outermost part 134X of the intermediate part 134.

Therefore, the user can easily sweep dust off a surface to be cleaned with the strips having higher rigidity on the first outermost part 134X side.

Insertion of the cleaning element holder 110 into the cleaning element 140 is now explained with reference to FIGS. 9 to 11.

Figure 9:
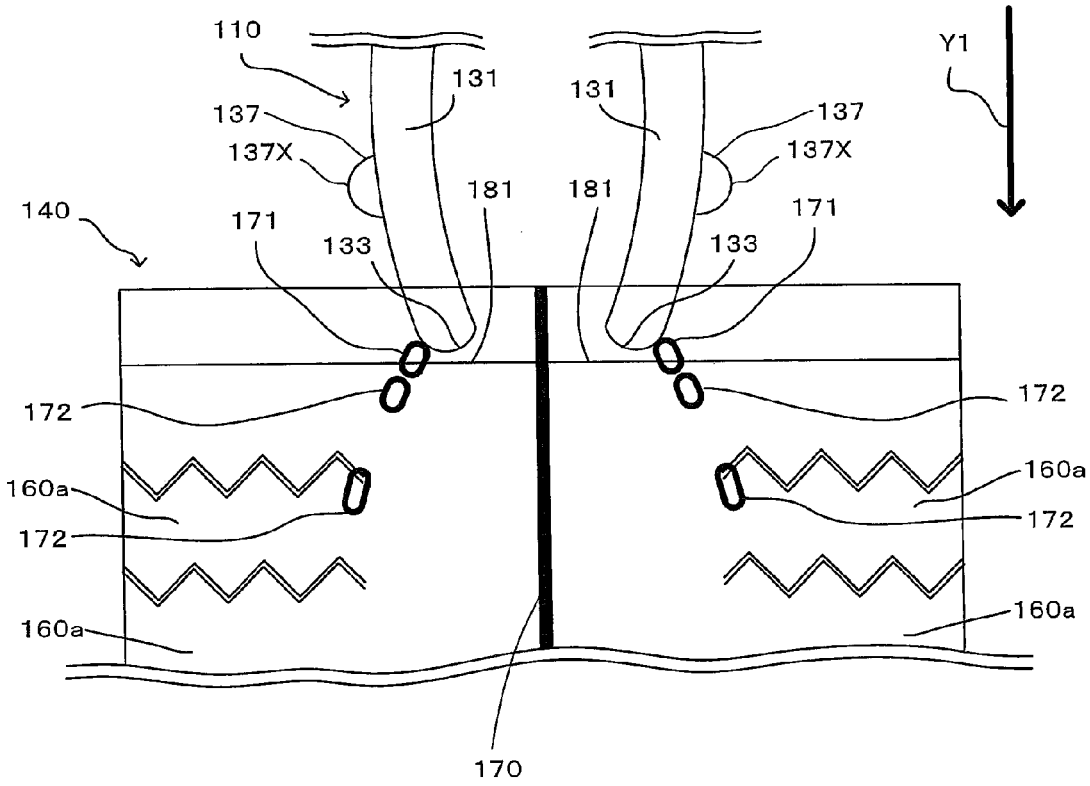
FIG. 9 is an explanatory drawing for showing insertion of the cleaning element holder into the cleaning element.

First, as shown in FIG. 9, the cleaning element holder 110 is moved in the inserting direction Y1. The tip parts 133 of the cleaning element holder 110 are then positioned in the openings 181 of the cleaning element 140.

The width of the pair openings 181 in the transverse direction X is shorter than the width of the cleaning element holder 110 at the pair tip parts 133 in the transverse direction X. Therefore, when the user inserts the tip parts 133 into the openings 181 and moves the cleaning element holder 110 in the inserting direction Y1, the pair holding members 131 are bent in the inside direction 100D2.

Figure 10:
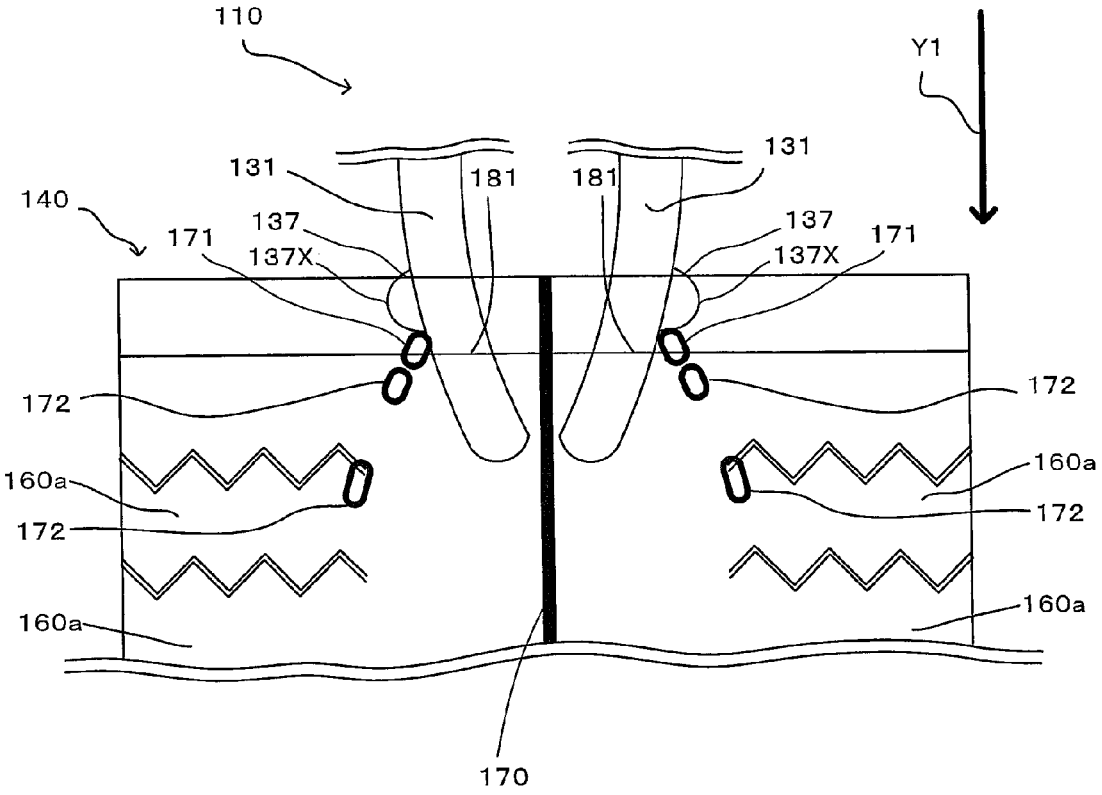
FIG. 10 is an explanatory drawing for showing insertion of the cleaning element holder into the cleaning element.

Next, as shown in FIG. 10, the first projections 137 contact the welding parts 171. Then, when the cleaning element holder 110 is further moved in the inserting direction Y1, the pair holding members 131 are bent in the inside direction 100D2 until the second outermost parts 137X of the first projections 137 pass the welding parts 171. When the second outermost parts 137X of the first projections 137 pass the welding parts 171, the pair holding members 131 try to return to the original state in the outside direction 100D1.

Figure 11:
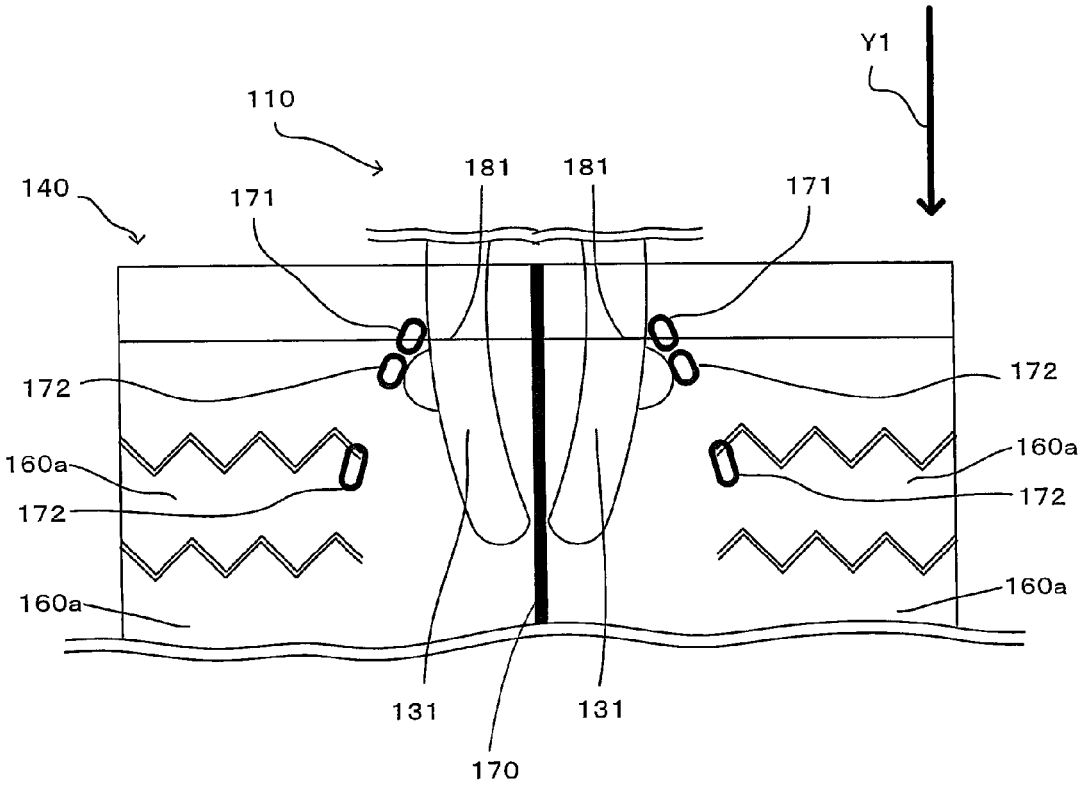
FIG. 11 is an explanatory drawing for showing insertion of the cleaning element holder into the cleaning element.

As shown in FIG. 11, when the first projections 137 pass the welding parts 171, return of the holding members 131 in the outside direction 100D1 is restricted by the welding parts 171. When the cleaning element holder 110 is further moved in the inserting direction Y1, the pair holding members 131 are bent in the inside direction 100D2 until the first outermost parts 134X pass the welding parts 171. When the first outermost parts 134X pass the welding parts 171, the pair holding members 131 move in the outside direction 100D1 to return to the original state. At this time, the first projections 137 also move in a similar manner.

Thus, when the cleaning element holder 110 is inserted in the inserting direction Y1, the possibility of contact of the first projections 137 with the other welding parts 172, 173 other than the welding parts 171 can be reduced.

When the cleaning element holder 110 attached to the cleaning element 140 is moved in the pulling-out direction Y2, the above-described movement is reversed.

Specifically, after the second projections 138 of the cleaning element holder 110 pass the welding parts 171, the pair holding members 131 are bent in the inside direction 100D2 until the first outermost parts 134X pass the welding parts 171. When the first outermost parts 134X pass the welding parts 171, the pair holding members 131 move in the outside direction 100D1 to return to the original state. At this time, the first projections 137 also move in a similar manner.

Thus, when the cleaning element holder 110 is pulled out in the pulling-out direction Y2, the possibility of contact of the first projections 137 with the other welding parts 172, 173 other than the welding parts 171 can be reduced.

Therefore, the cleaning tool 100 according to this embodiment allows a user to perform smooth operation in inserting the cleaning element holder 110 into the cleaning element 140 and pulling the cleaning element holder 110 out of the cleaning element 140.

Further, according to this embodiment, by provision of the structure in which the strips 153*a* of the cleaning side sheet 153 are narrower than the strips 151*a* of the base sheet 151, the fibers of the fiber assembly 152 can be easily entangled with the strips 153*a* of the cleaning side sheet 153. Specifically, by entanglement of the fibers with the strips 153*a* on a side of the cleaning element 140 facing the object to be cleaned, the side of the cleaning element 140 facing the object to be cleaned can be made bulkier. Therefore, the cleaning function of capturing dust or dirt can be further enhanced. On the other hand, the strips 151*a* of the base sheet 151 and the strips 160*a* of the holding sheet 160 can be less easily entangled with the fibers of the fiber assembly 152 than the strips 153*a* of the cleaning side sheet 153. Therefore, the strips 151*a*, 160*a* can exhibit a dust sweeping-out function independently from movement of the fiber assembly 152.

In this embodiment, preferably, the welding parts 171, 172, 173 are arranged symmetrically not only with respect to the center welding line 170 but also with respect to a line passing through the center of the center welding line 170 and perpendicular to the center welding line 170. With this structure, the holding member 131 can be inserted into the holding space 180 from either of the openings 181.

The present invention is not limited to the embodiment as described above, but rather, may be added to, changed, replaced with alternatives or otherwise modified. For example, the following modifications can also be performed in application of the above-described embodiment.

(First Modification)

A first modification is now explained with reference to FIGS. 12 to 14. The cleaning tool of the first modification is different from the cleaning tool 100 of the first embodiment in the structure of the cleaning element holding part 130 of the cleaning element holder 110.

The intermediate part 134 of the cleaning element holding part 130 in the first modification includes a first elastic member 135 and a second elastic member 136. Specifically, the first elastic member 135 and the second elastic member 136 are connected to each other at the base part 132 and the tip part 133 and configured to be spaced apart from each other in a region of an intermediate portion between the base part 132 and the tip part 133. As shown in FIG. 13, in the region of the intermediate portion between the base part 132 and the tip part 133, the first elastic member 135 is convexly curved to the lower side of the cleaning element holder 110 (downward as viewed in FIG. 13) from the base part 132 and the tip part 133. On the other hand, in this intermediate region, the second elastic member 136 is convexly curved to the upper side of the cleaning element holder 110 (upward as viewed in FIG. 13) from the base part 132 and the tip part 133.

Figure 12:
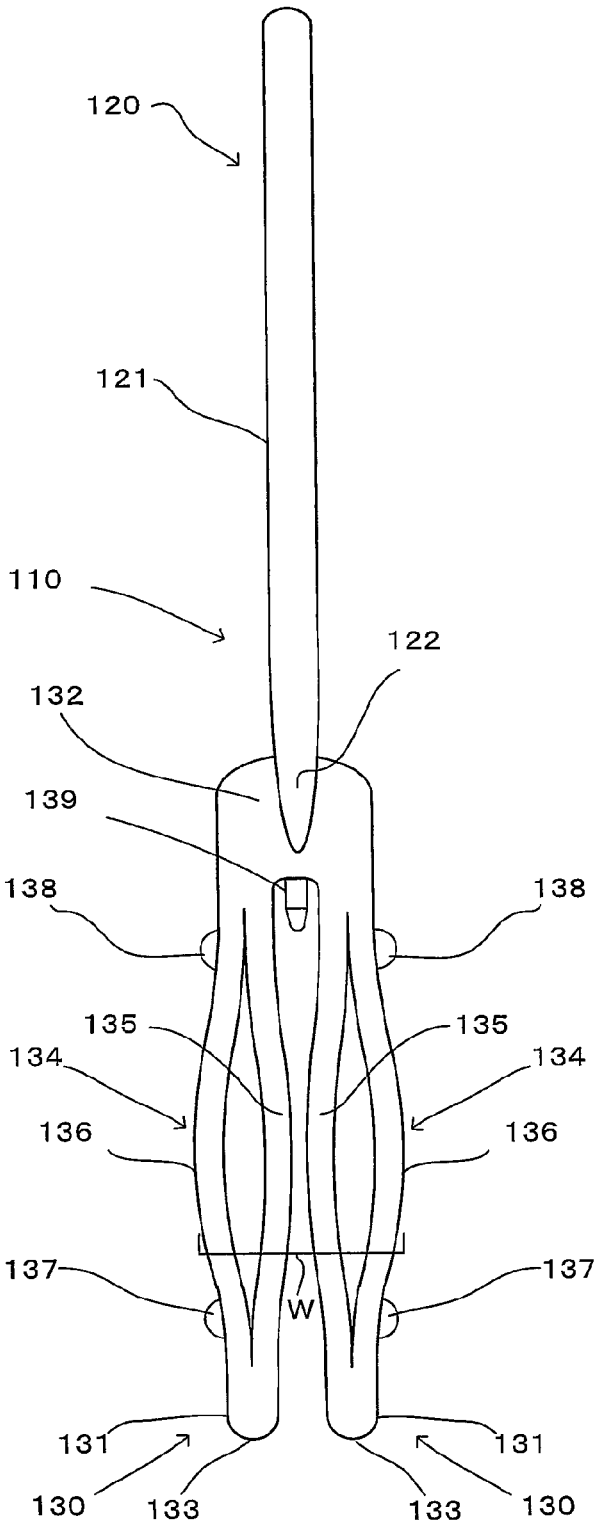
FIG. 12 is a plan view of the cleaning element holder according to a first modification of the present invention.

Further, as shown in FIG. 12, the first elastic members 135 of the holding members 131 are arranged to be located closer to each other in the region of the intermediate portion between the base part 132 and the tip part 133, while the second elastic members 136 of the holding members 131 are arranged to be located away from each other in this intermediate region.

The intermediate part 134 having the above-described structure is arranged such that the first elastic member 135 and the second elastic member 136 which form one holding member 131 are most spaced apart from each other in the vertical direction and in the right and left direction of the cleaning element holder 110 in the region of the intermediate portion between the base part 132 and the tip part 133. The distance between the elastic members is indicated by a horizontal distance W in the right and left direction of the cleaning element holder 110 as shown in FIG. 12, and a vertical distance D in the vertical direction of the cleaning element holder 110 as shown in FIG. 13. The first and second elastic members 135, 136 are formed of resin material and configured to bend in the vertical direction and in the right and left direction of the cleaning element holder 110 by elastic deformation. The vertical distance D of the cleaning element holder 110 in its original state is preferably 250% or more of the distance between the first and second elastic members 135 and 136 which are vertically moved close to each other by elastic deformation.

As shown in FIG. 12, the projections 137, 138 are formed on the lateral outer side surface of the second elastic member 136. Specifically, the projection 137 is formed on the tip part 133 side of the second elastic member 136, and the projection 138 is formed on the base part 132 side of the second elastic member 136. The projections 137, 138 have a semicircular shape in plan view.

Engagement of the cleaning element holder 110 and the cleaning element 140 is explained with reference to FIG. 14.

The width of the opening 181 of the holding space 180 is smaller than a larger one of the horizontal distance W and the vertical distance D between the first elastic member 135 and the second elastic member 136. Therefore, in the process of inserting the holding member 131 into the holding space 180, the first elastic member 135 and the second elastic member 136 elastically deform toward each other when passing through the opening 181.

When inserted through the opening 181, the first elastic member 135 and the second elastic member 136 deform in a direction away from each other in the intermediate region between the base part 132 and the tip part 133 by their restoring forces. Specifically, the elastic members deform so as to return to the original state. As a result, as shown in FIG. 14, the holding space 180 is vertically expanded by the first and second elastic members 135, 136.

Upon completion of insertion of the holding member 131 into the holding space 180, the projections 137, 138 are held between the welding parts 172. Further, as shown in FIG. 14, the first elastic member 135 pushes the holding sheet 160 upward and the second elastic member 136 pushes the base sheet 151 downward by their respective restoring forces. As a result, the holding member 131 is engaged with the intermediate region 182 within the holding space 180. At this time, the retaining plate 139 presses the cleaning element 140 from above, and the engagement lug (not shown) on the underside of the retaining plate 139 serves as a stopper for the cleaning element 140. In this manner, the cleaning element 140 is reliably held by the cleaning element holding part 130. Further, the holding member 131 may be inserted into the holding space 180 from either of the openings 181 formed on the both ends of the cleaning element 140.

According to the above-described first modification, the cleaning element 140 is held by the cleaning element holder 110 while the cleaning element holding part 130 vertically expands the cleaning element 140. Specifically, the holding member 131 is formed by the elastically deformable first and second elastic members 135, 136, and expands the cleaning element 140 in the thickness direction by the restoring forces of the first and second elastic members 135, 136. Therefore, the cleaning element 140 is held in the expanded or bulky state.

Especially, the fiber assembly 152 is made bulkier. This state of the fiber assembly 152 can be defined as providing a high bulky feeling, and also referred to as a "bulky state", "volume-up state", "high space-fullness state" or "high bulkiness state".

The cleaning effect can be enhanced by increasing the bulkiness of the fiber assembly 152. Further, due to the increased bulkiness of the fiber assembly 152, the fiber assembly 152 makes closer contact with a surface to be cleaned. Therefore, dirt of the fiber assembly 152 easily stands out (the fiber assembly 152 is easily blackened), so that the user can get a higher level of satisfaction, realizing that dust or dirt is reliably captured.

Further, according to the first modification, the first elastic member 135 and the second elastic member 136 are spaced apart from each other not only in the vertical direction of the cleaning element holder 110 but also in the right and left direction of the cleaning element holder 110. Specifically, the first elastic member 135 and the second elastic member 136 not only hold the cleaning element 140 in a bulky state by being spaced apart from each other in the thickness direction of the cleaning element 140, but also ensure the area of the cleaning element 140 in plan view by being spaced apart from each other in a direction crossing the thickness direction of the cleaning element 140. In other words, the cleaning element 140 is held bulky while restricting reduction of the area of the cleaning element 140 in plan view. Therefore, the cleaning element 140 can be held bulky in a wider range, so that the cleaning efficiency can be enhanced.

When the cleaning element 140 is held by the cleaning element holder 110, the holding member 131 presses against the cleaning element 140 in a direction to expand an internal space of the holding space 180. The holding space 180 is defined between the first insertion region 180A formed by the holding sheet 160 and the second insertion region 180B formed by the base sheet 151. Specifically, the first elastic member 135 of the holding member 131 presses against the second insertion region 180B of the holding space 180 and the second elastic member 136 of the holding member 131 presses against the first insertion region 180A of the holding space 180. As a result, tension is applied to the first insertion region 180A and the second insertion region 180B in the holding space 180. Specifically, the first elastic member 135 and the second elastic member 136 of the holding member 131 are formed as a tension applying part 190 for applying prescribed tension, particularly to the second insertion region 180B in the holding space 180. Further, the second elastic member 136 and the first elastic member 135 are formed as a first tension applying part 190A and a second tension applying part 190B, respectively.

The first elastic member 135 is disposed inward of the second elastic member 136 in the transverse direction X. Specifically, the second tension applying part 190B is disposed inward of the first tension applying part 190A in the transverse direction X.

Figure 13:
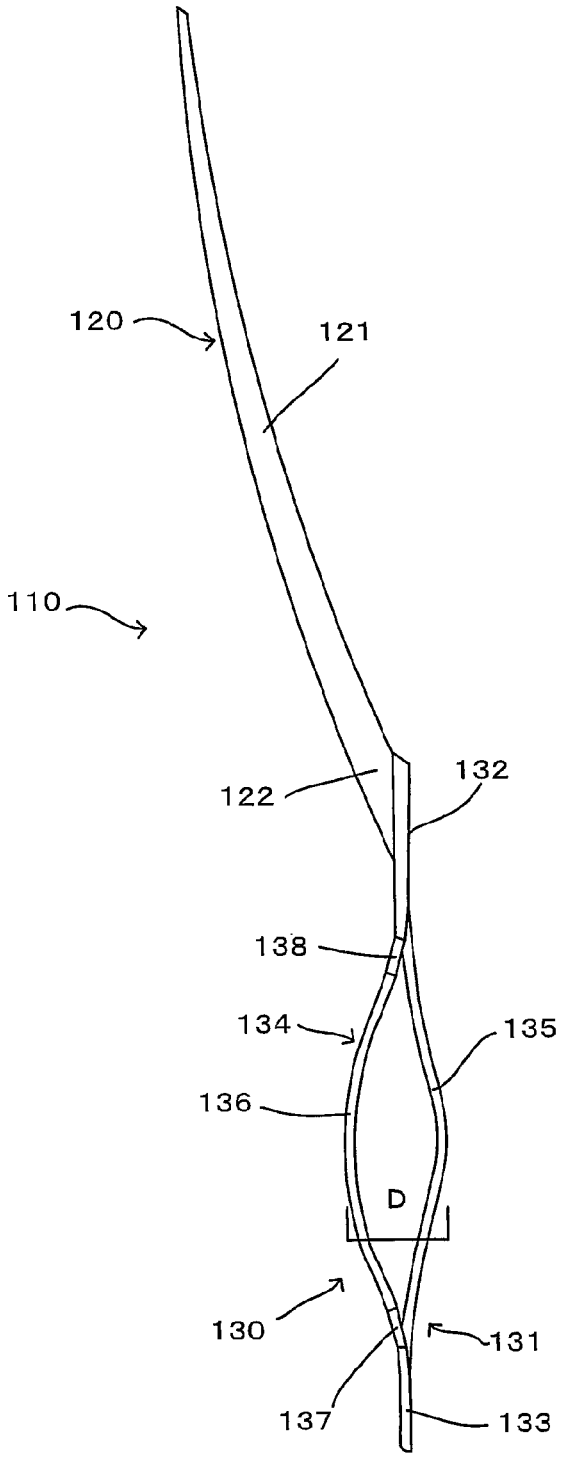
FIG. 13 is a side view of the cleaning element holder according to the first modification of the present invention.
Figure 14:
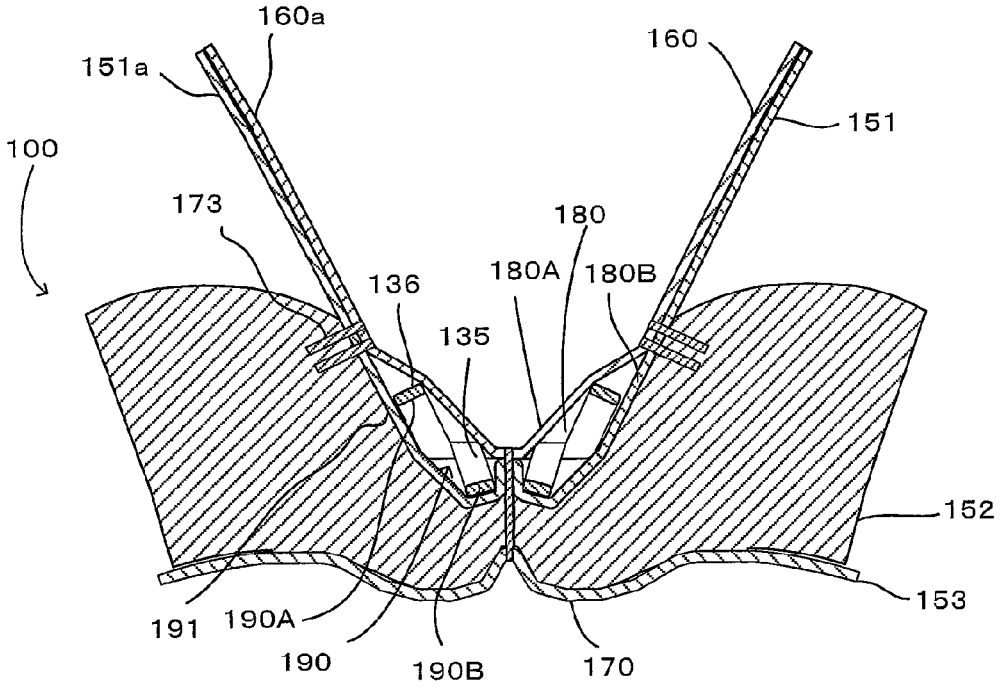
FIG. 14 is a sectional view for showing insertion of the cleaning element holder into the cleaning element according to the first modification of the present invention.
Figure 15:
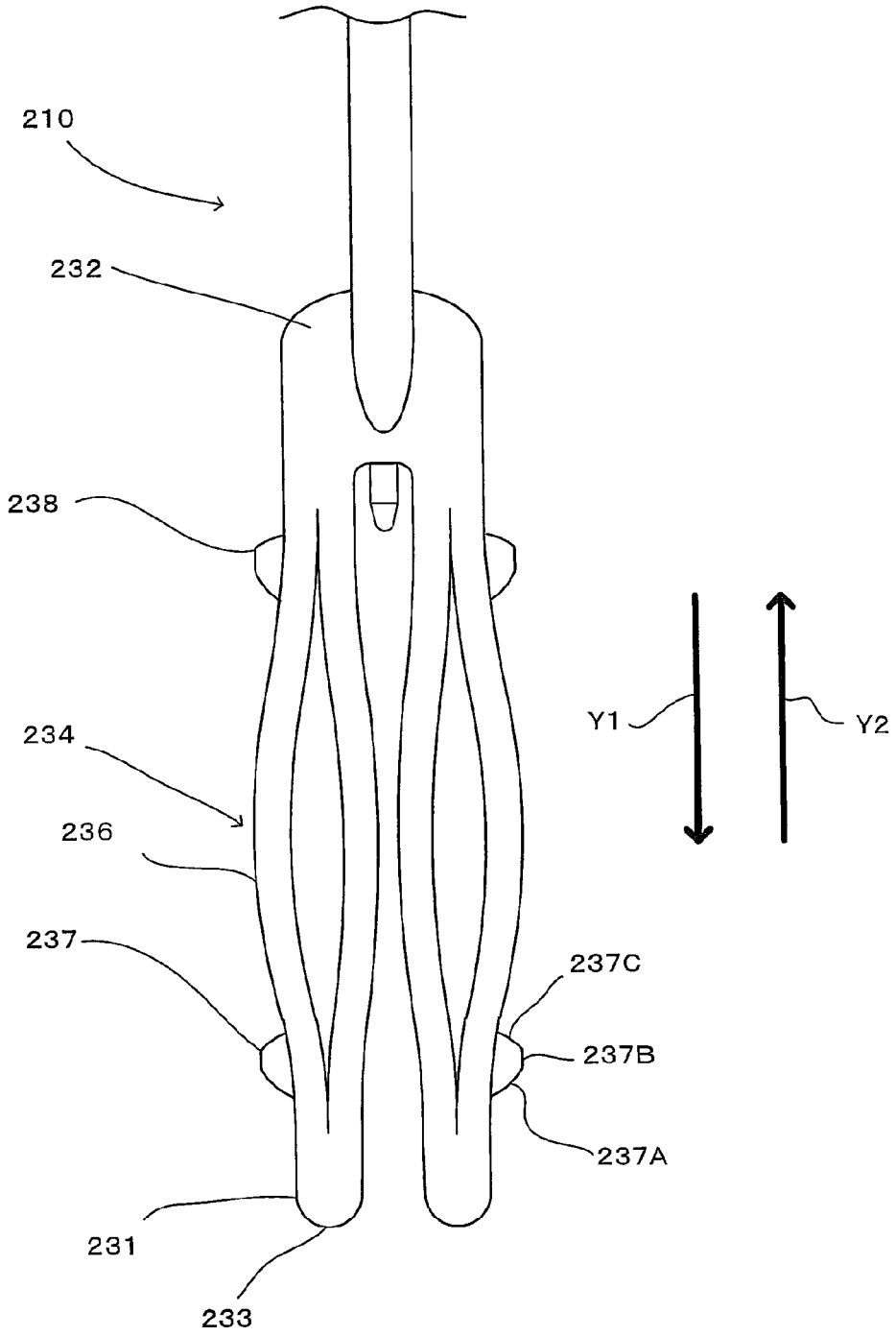
FIG. 15 is a plan view of a second modification of the present invention.

Therefore, the second insertion region 180B is inclined from the second tension applying part 190B (the first elastic member 135) to the first tension applying part 190A (the second elastic member 136) while tension is applied to the second insertion region 180B in an upward direction (upward as viewed in FIG. 13). Thus, the second insertion region 180B forms a tension part 191.

Thus, the second insertion region 180B is inclined in a direction toward the first insertion region 180A (upward as viewed in FIG. 13). Further, the strips 160*a*, 151*a* contiguous to the second insertion region 180B are also moved in the direction toward the first insertion region 180A (upward as viewed in FIG. 13).

As a result, in the cleaning element 140, the distance between the strips 160*a*, 151*a* and the cleaning side sheet 153 is expanded. Therefore, a region of the cleaning element 140 to get into contact with the object to be cleaned can be increased.

Further, in the cleaning tool 100 having the fiber assembly 152 of this type, the user may open the fiber assembly 152 by shaking the cleaning tool 100 before use. In the present invention, a region of the fiber assembly 152 to be opened can be ensured, so that the opened state of the fiber assembly 152 is excellent.

Further, the cleaning element holding part 130 has a bifurcated shape having a pair of the holding members 131, so that reduction of the area of the cleaning element 140 in plan view can be further restricted while the cleaning element 140 is held in the bulky state.

Further, according to the first modification, the first elastic member 135 and the second elastic member 136 are most spaced apart from each other in the vertical direction and in the right and left direction of the cleaning element holder 110 in the intermediate portion which is located at an equal distance from the base part 132 and the tip part 133. Therefore, the cleaning element 140 held by the cleaning element holder 110 can be made bulkiest in its center. Thus, the cleaning element 140 can be efficiently held bulky.

Further, according to the first modification, with the cleaning element 140 held by the cleaning element holder 110, the holding member 131 is engaged with the intermediate region 182 within the holding space 180 by the restoring forces of the first and second elastic members 135, 136. Specifically, by the restoring forces of the first and second elastic members 135, 136, the cleaning element 140 can be prevented from coming off the cleaning element holder 110 during cleaning.

(Second Modification)

A second modification is now explained with reference to FIGS. 15 to 24. A second elastic member 236 has projections 237, 238. The projection 237 is formed on a tip part 233 side of the second elastic member 236, and the projection 238 is formed on a base part 232 side of the second elastic member 236.

The projection 237 has an inserting side region 237A on a front side in the inserting direction Y1 and a pulling-out side region 237C on a front side in the pulling-out direction Y2. Further, the projection 237 has an intermediate region 237B between the inserting side region 237A and the pulling-out side region 237C. The inserting side region 237A, the intermediate region 237B and the pulling-out side region 237C are example embodiments that correspond to the "inserting side region", the "intermediate region" and the "pulling-out side region", respectively, according to this invention.

The structure of the projection 237 is now explained. For the sake of convenience, only the structure of the projection 237 on the tip part 133 side is explained. Naturally, the projection 238 on the base part 132 side has the same structure as the projection 237.

Figure 16:
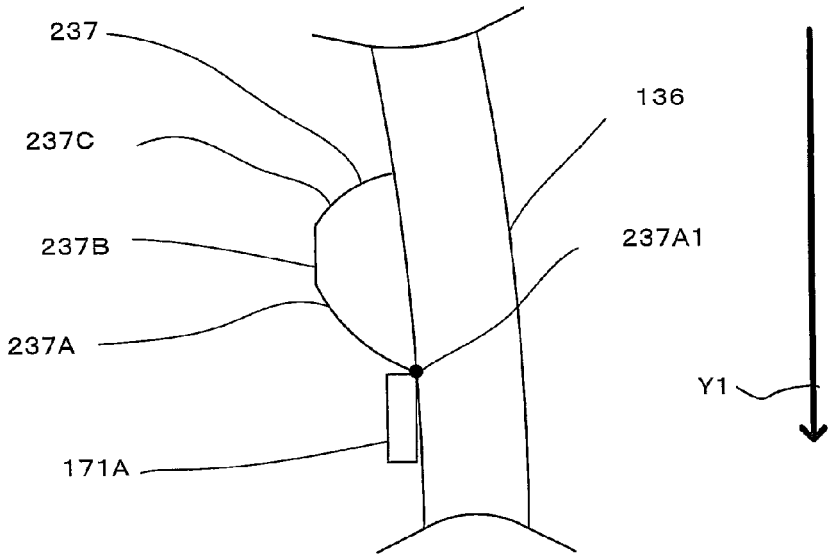
FIG. 16 is an explanatory drawing of the second modification of the present invention.

FIG. 16 shows the state at the beginning of inserting a holding member 231 of a cleaning element holder 210 into the holding space 180 of the cleaning element 140 by moving the cleaning element holder 210 in the inserting direction Y1.

At this time, the inserting side region 237A of the projection 237 gets into contact with a bonded part 171A of the cleaning element 140. A point where the inserting side region 237A first gets into contact with the bonded part 171A is defined as an insertion starting point 237A1. The insertion starting point 237A1 is an example embodiment that corresponds to the "insertion starting point" according to this invention.

Figure 17:
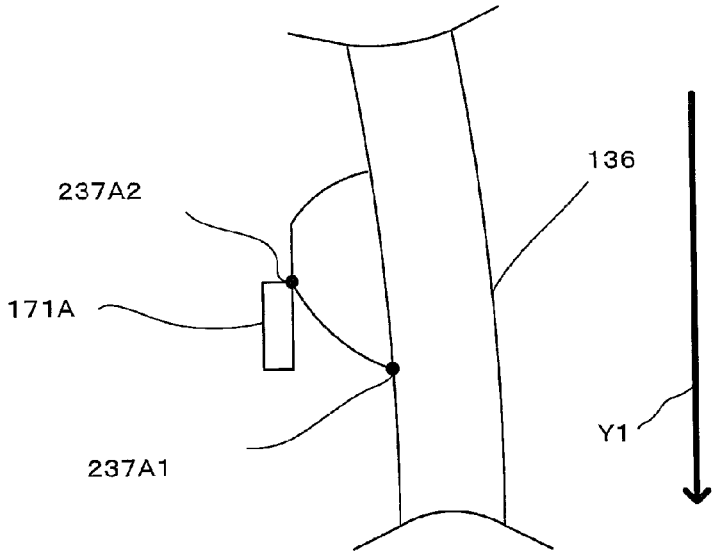
FIG. 17 is an explanatory drawing of the second modification of the present invention.

Then, as shown in FIG. 17, the cleaning element holder 210 is further moved in the inserting direction Y1 up to an end point of contact of the inserting side region 237A with the bonded part 171A, which point is defined as an insertion end point 237A2. The insertion end point 237A2 is an example embodiment that corresponds to the "insertion end point" according to this invention.

Figure 18:
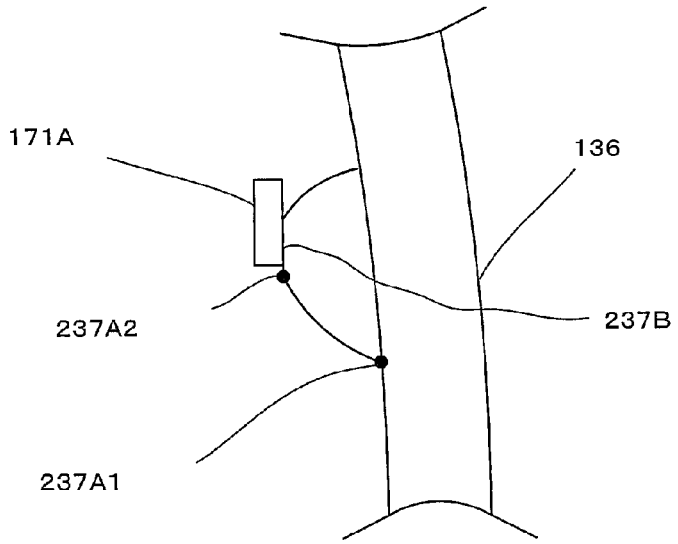
FIG. 18 is an explanatory drawing of the second modification of the present invention.

Next, as shown in FIG. 18, the cleaning element holder 210 is further moved in the inserting direction Y1. The bonded part 171A then gets into contact with the intermediate region 237B, while passing through the insertion end point 237A2. Then by further moving the cleaning element holder 210 in the inserting direction Y1, attachment of the cleaning element holder 210 to the cleaning element 140 is completed.

Figure 19:
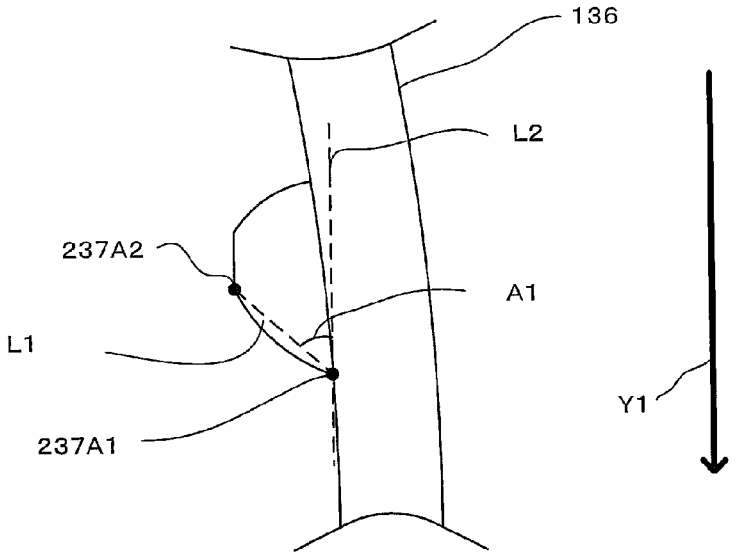
FIG. 19 is an explanatory drawing of the second modification of the present invention.

Here, as shown in FIG. 19, a line connecting the insertion starting point 237A1 and the insertion end point 237A2 is defined as a first projection virtual line L1. A line parallel to the inserting direction Y1 and passing through the insertion starting point 237A1 is defined as a second projection virtual line L2. Further, an angle made by the first projection virtual line L1 and the second projection virtual line L2 is defined as a first angle A1.

The first projection virtual line L1, the second projection virtual line L2 and the first angle A1 are example embodiments that correspond to the "first projection virtual line", the "second projection virtual line" and the "first angle", respectively, according to this invention.

Figure 20:
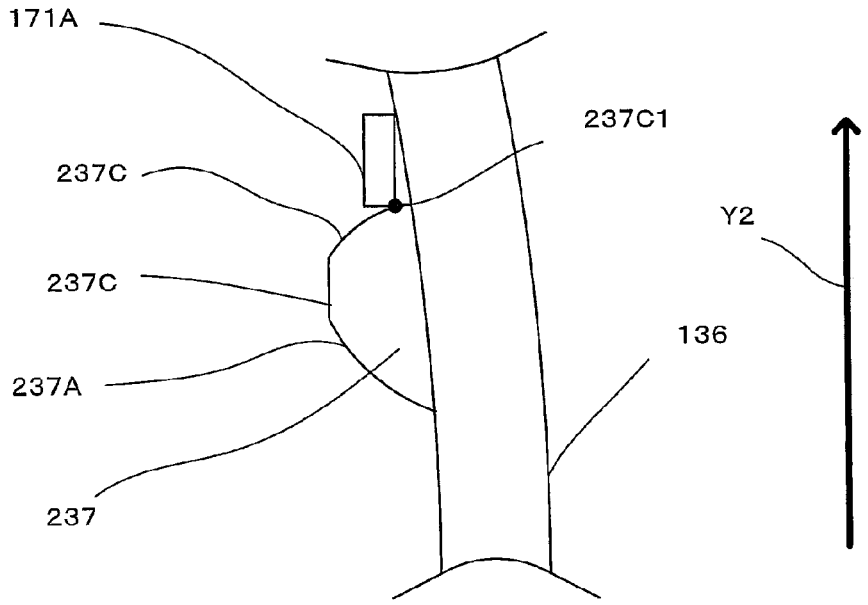
FIG. 20 is an explanatory drawing of the second modification of the present invention.

FIG. 20 shows the state at the beginning of moving the cleaning element holder 210 attached to the cleaning element 140 in the pulling-out direction Y2.

At this time, the pulling-out side region 237C of the projection 237 gets into contact with the bonded part 171A of the cleaning element 140. A point where the pulling-out side region 237C first gets into contact with the bonded part 171A is defined as a pulling-out starting point 237C1. The pulling-out starting point 237C1 is an example embodiment that corresponds to the "pulling-out starting point" according to this invention.

Figure 21:
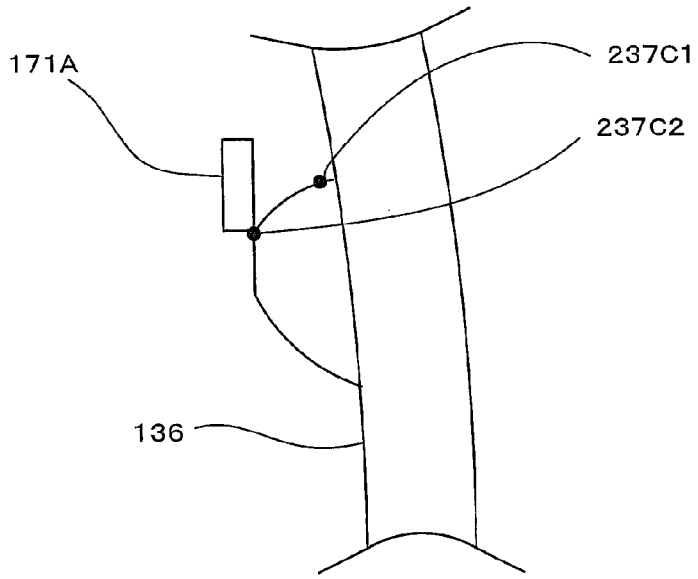
FIG. 21 is an explanatory drawing of the second modification of the present invention.

Then, as shown in FIG. 21, the cleaning element holder 210 is further moved in the pulling-out direction Y2 up to an end point of contact of the pulling-out side region 237C with the bonded part 171A, which point is defined as a pulling-out end point 237C2. The pulling-out end point 237C2 is an example embodiment that corresponds to the "pulling-out end point" according to this invention.

Figure 22:
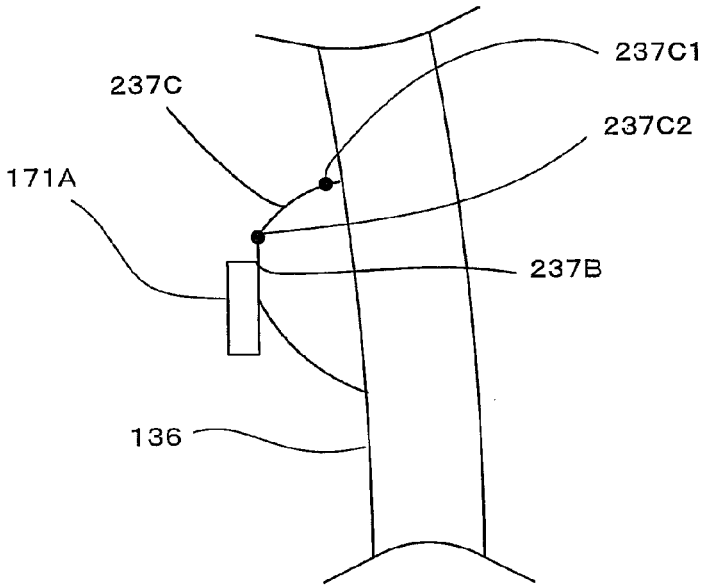
FIG. 22 is an explanatory drawing of the second modification of the present invention.

Next, as shown in FIG. 22, the cleaning element holder 210 is further moved in the pulling-out direction Y2. The bonded part 171A then gets into contact with the intermediate region 237B, while passing through the pulling-out end point 237C2. Then by further moving the cleaning element holder 210 in the pulling-out direction Y2, the cleaning element holder 210 is detached from the cleaning element 140.

Figure 23:
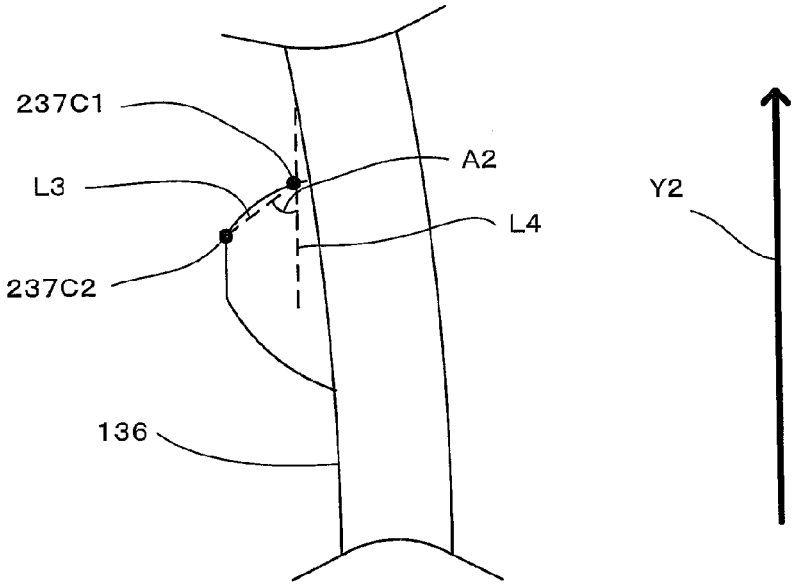
FIG. 23 is an explanatory drawing of the second modification of the present invention.

Here, as shown in FIG. 23, a line connecting the pulling-out starting point 237C1 and the pulling-out end point 237C2 is defined as a third projection virtual line L3. A line parallel to the pulling-out direction Y2 and passing through the pulling-out starting point 237C1 is defined as a fourth projection virtual line L4. Further, an angle made by the third projection virtual line L3 and the fourth projection virtual line L4 is defined as a second angle A2.

The third projection virtual line L3, the fourth projection virtual line L4 and the second angle A2 are example embodiments that correspond to the "third projection virtual line", the "fourth projection virtual line" and the "second angle", respectively, according to this invention.

Figure 24:
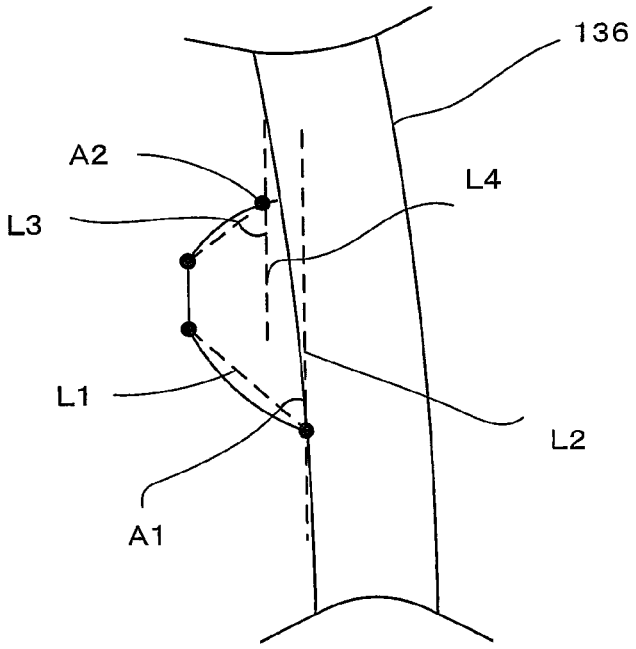
FIG. 24 is an explanatory drawing of the second modification of the present invention.

Here, as shown in FIG. 24, the first angle A1 is smaller than the second angle A2. This feature is an example embodiment that corresponds to the feature that "the first angle is smaller than the second angle" according to this invention.

By providing the projection 237 having such a structure, the cleaning element holder 210 can be smoothly attached to the cleaning element 140. Further, the cleaning element holder 210 is not easily separated from the cleaning element 140 during use of the cleaning tool 100.

(Third Modification)

Figure 25:
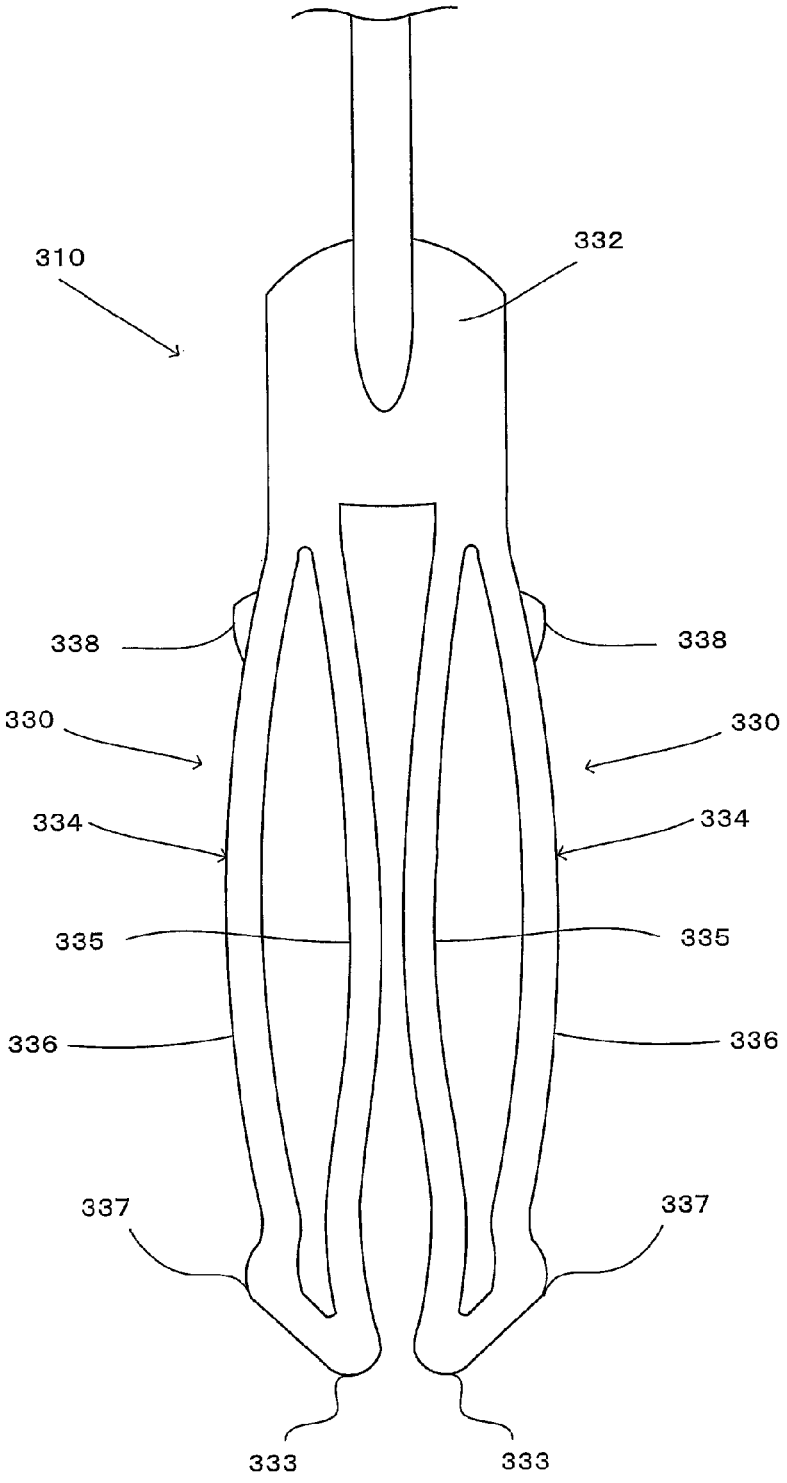
FIG. 25 is a plan view of a third modification of the present invention.

A third modification is explained with reference to FIGS. 25 and 26. A cleaning element holding part 330 of a cleaning element holder 310 according to the third modification includes a first elastic member 335 and a second elastic member 336. The second elastic member 336 has a projection 337 on a tip part 333 side and a projection 338 on a base part 332 side. The projection 337 on the tip part 333 side is formed by deforming a region of the tip part 333 of the second elastic member 336 in the outside direction.

Specifically, the projection 337 on the tip part 333 side of the cleaning element holder 310 according to the third modification has an unclear boundary with the second elastic member 336, compared with the projection 237 on the tip part 233 side of the cleaning element holder 210 according to the second modification.

As for the projection 337 having such a structure, especially a starting point of an inserting side region 337A of the projection 337 needs to be discussed.

Therefore, how to obtain the "first angle" of the projection 337 having the above-described structure is explained with reference to FIG. 26.

Figure 26:
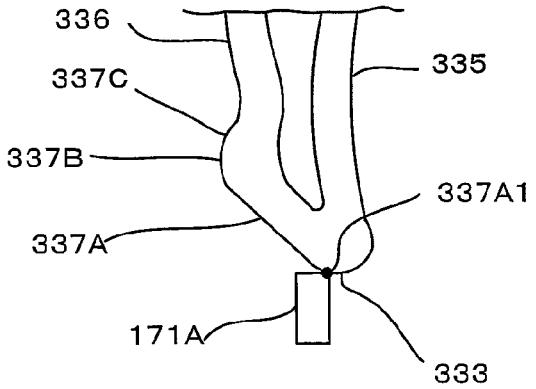
FIG. 26 is an explanatory drawing of the third modification of the present invention.

FIG. 26 shows the state at the beginning of inserting the holding member 331 of the cleaning element holder 310 into the holding space 180 of the cleaning element 140 by moving the cleaning element holder 310 in the inserting direction Y1.

At this time, an inserting side region 337A of the projection 337 gets into contact with a bonded part 171A of the cleaning element 140. A point where the inserting side region 337A first gets into contact with the bonded part 171A is defined as an insertion starting point 337A1. A part of the projection 337 extending from the insertion starting point 337A1 to an intermediate part 337B is defined as the inserting side region 337A.

In this manner, even in the structure of the projection 337, like in the above-described second modification, the insertion starting point 337A1 and an insertion end point can be identified, so that the first angle of the projection 337 can be obtained.

(Fourth Modification)

Figure 27:
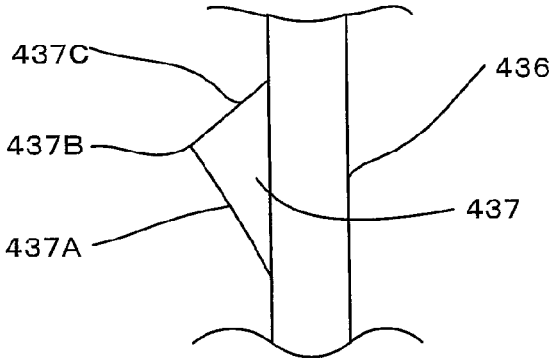
FIG. 27 is an explanatory drawing of a fourth modification of the present invention.

A fourth modification is explained with reference to FIGS. 27 and 28. For the sake of convenience, only the structure of a projection 437 on the tip part side of a second elastic member 436 is shown and explained.

The projection 437 has a straight inserting side region 437A, a straight pulling-out side region 237C and a point-like intermediate region 437B.

Figure 28:
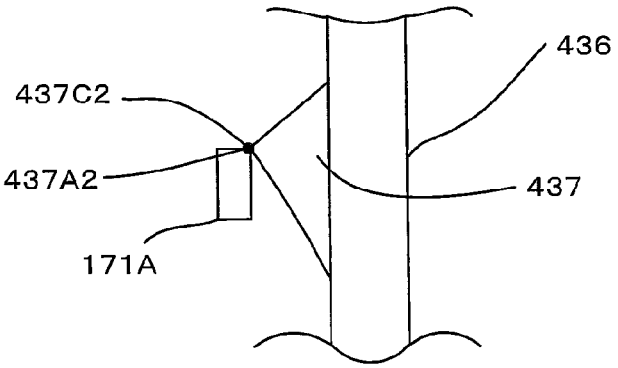
FIG. 28 is an explanatory drawing of the fourth modification of the present invention.

FIG. 28 is an explanatory drawing for showing both the state in which the holding member of the cleaning element holder is inserted into the holding space 180 of the cleaning element 140 by moving the cleaning element holder in the inserting direction Y1 and the state in which the holding member of the cleaning element holder is pulled out of the holding space 180 of the cleaning element 140 by moving the cleaning element holder in the pulling-out direction Y2.

In the projection 437 having such a structure, an insertion end point 437A2 coincides with a pulling-out end point 437C2 at the intermediate region 437B. Even in such a structure in which the insertion end point 437A2 coincide with the pulling-out end point 437C2 at a point on the projection 437, there arises no problem in obtaining the "first angle" and the "second angle".

(Fifth Modification)

Figure 29:
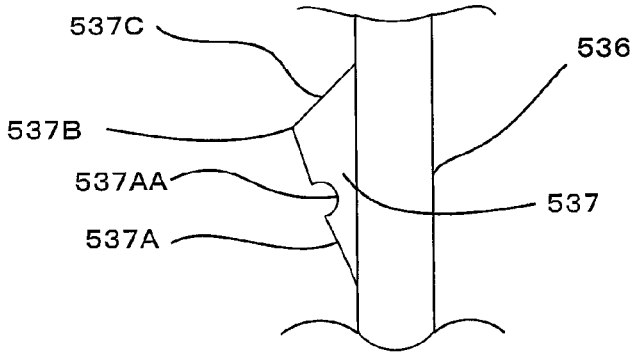
FIG. 29 is an explanatory drawing of a fifth modification of the present invention.

A fifth modification is explained with reference to FIGS. 29 and 30. For the sake of convenience, only the structure of a projection 537 on the tip part side of a second elastic member 536 is shown and explained.

The projection 537 has a recess 537AA in an inserting side region 537A.

Figure 30:
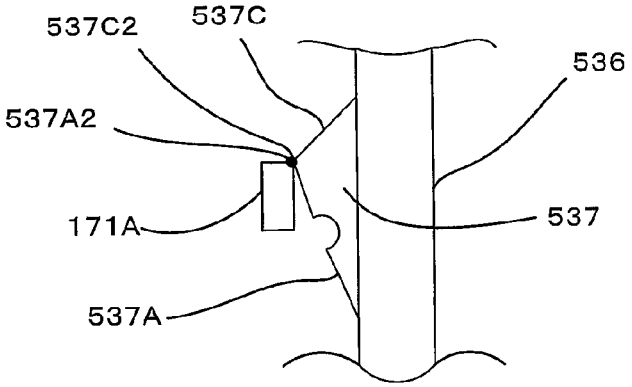
FIG. 30 is an explanatory drawing of the fifth modification of the present invention.

FIG. 30 is an explanatory drawing for showing the state in which the holding member of the cleaning element holder is inserted into the holding space 180 of the cleaning element 140 by moving the cleaning element holder in the inserting direction Y1.

Due to existence of the recess 537AA, the state of contact between the inserting side region 537A and the bonded part 171A in the projection 537 is different from that in the above-described second to fourth modifications.

Specifically, the bonded part 171A passes through the recess 537AA on the way from an insertion starting point (not shown) to an insertion end point 537A2 on an inserting side region 537A of the projection 537.

Even in such a structure having the recess 537AA in the inserting side region 537A, the insertion end point 537A2 is an end point of contact of the inserting side region 537A with the bonded part 171A. The same is true for a structure in which a pulling-out side region 537C has a recess.

Therefore, even in the structure having the recess 537AA in the projection 537, there arises no problem in obtaining the "first angle" and the "second angle".

The second to fifth modifications shown in FIGS. 15 to 30 are explained above, focusing on the structure of the projection on the tip part side. Naturally, the above-described structure of the projection on the tip part side can be appropriately applied to the projection on the base part side.

Further, in the second to fifth modifications shown in FIGS. 15 to 30, for the sake of convenience, only the "bonded part 171A" is explained as a bonded part of the cleaning element which comes in contact with the projection of the cleaning element holder. Naturally, when obtaining the first and second angles A1, A2, these modifications can also be appropriately applied to bonded parts having various shapes and assemblies of bonded parts arranged in various ways.

In such a case, for example, depending on the shape of the bonded parts and arrangement of a plurality of the bonded parts in the cleaning element and the structure of the intermediate part of the cleaning element holder, the bonded parts arranged continuously in the longitudinal direction may have different first angles A1 and second angles A2.

When varying in the first angle A1, a smallest one of the first angles A1 is defined as the "first angle" according to this invention. When varying in the second angle A2, a largest one of the second angles A2 is defined as the "second angle" according to this invention.

In the above-described embodiment and modifications, the cleaning element holder 110 is described as having a bifurcated shape having the two holding members 131, but it may be shaped otherwise, having only one holding member 131.

(Correspondences Between the Features of the Embodiment and the Features of the Invention)

The cleaning tool 100 is an example embodiment that corresponds to the "cleaning tool" according to this invention. The cleaning element 140 is an example embodiment that corresponds to the "cleaning sheet" according to this invention. The cleaning element holder 110, 210, 310 is an example embodiment that corresponds to the "holder" according to this invention. The longitudinal direction Y and the transverse direction X are example embodiments that correspond to the "longitudinal direction" and the "transverse direction", respectively, according to this invention. The transverse direction center point XCP and the longitudinal center line YCL are example embodiments that correspond to the "transverse direction center point" and the "longitudinal center line", respectively, according to this invention. The outside direction 100D1 and the inside direction 100D2 are example embodiments that correspond to the "outside direction" and the "inside direction", respectively, according to this invention. The holding space 180 is an example embodiment that corresponds to the "insertion part" according to this invention. The cleaning element holding part 130, 230, 330 is an example embodiment that corresponds to the "holding part" according to this invention. The first outermost part 134X is an example embodiment that corresponds to the "first outermost part" according to this invention. The projection 137, 138, 237, 238, 337, 338, 437, 537 is an example embodiment that corresponds to the "projection" according to this invention. The second outermost part 137X is an example embodiment that corresponds to the "second outermost part" according to this invention. The handle part 120 is an example embodiment that corresponds to the "grip part" according to this invention. The first outermost virtual line X1 and the second outermost virtual line X2 are example embodiments that correspond to the "first outermost virtual line" and the "second outermost virtual line", respectively, according to this invention. The base part 132, 232, 332 is an example embodiment that corresponds to the "connection part" according to this invention. The tip part 133, 233, 333 is an example embodiment that corresponds to the "tip part" according to this invention. The intermediate part 134, 234, 334 is an example embodiment that corresponds to the "extending part" according to this invention. The projection 137, 237, 337, 437, 537 is an example embodiment that corresponds to the "first projection" according to this invention. The projection 138, 238, 338 is an example embodiment that corresponds to the "second projection" according to this invention. The cleaning element body 150 is an example embodiment that corresponds to the "contact sheet" according to this invention. The holding sheet 160 is an example embodiment that corresponds to the "holding sheet" according to this invention. The welding part 171, 172, 173, 171A is an example embodiment that corresponds to the "bonded part" according to this invention. The inserting side region 237A, 337A, 437A, 537A is an example embodiment that corresponds to the "inserting side region" according to this invention. The pulling-out side region 237C, 337C, 437C, 537C is an example embodiment that corresponds to the "pulling-out side region" according to this invention. The intermediate region 237B, 337B, 437B, 537B is an example embodiment that corresponds to the "intermediate region" according to this invention. The insertion starting point 237A1, 337A1 is an example embodiment that corresponds to the "insertion starting point" according to this invention. The insertion end point 237A2, 437A2, 537A2 is an example embodiment that corresponds to the "insertion end point" according to this invention. The first projection virtual line L1, the second projection virtual line L2 and the first angle A1 are example embodiments that correspond to the "first projection virtual line", the "second projection virtual line" and the "first angle", respectively, according to this invention. The pulling-out starting point 237C1 is an example embodiment that corresponds to the "pulling-out starting point" according to this invention. The pulling-out end point 237C2, 437C2, 537C2 is an example embodiment that corresponds to the "pulling-out end point" according to this invention. The third projection virtual line L3, the fourth projection virtual line L4 and the second angle A2 are example embodiments that correspond to the "third projection virtual line", the "fourth projection virtual line" and the "second angle", respectively, according to this invention.

In view of the nature of the above-described invention, a cleaning tool according to this invention can be provided with various features.

(Aspect 1)

A cleaning tool, having a cleaning sheet and a holder for holding the cleaning sheet, wherein:

the cleaning tool has a longitudinal direction in which the holder is inserted into the cleaning sheet; a transverse direction crossing the longitudinal direction; a transverse direction center point which is a center point on the cleaning tool in the transverse direction; a longitudinal center line which is a line passing through the transverse direction center point in parallel to the longitudinal direction; an outside direction which is a direction away from the transverse direction center point on the cleaning tool; and an inside direction which is a direction toward the transverse direction center point on the cleaning tool, the cleaning sheet has an insertion part into which the holder is inserted, the holder includes a holding part which is inserted into the insertion part of the cleaning sheet, a first outermost part of the holding part which projects most in the outside direction in the transverse direction, a projection which is formed in the outside direction in the holding part, a second outermost part of the projection which projects most in the outside direction in the transverse direction, and a grip part which is connected to the holding part and designed to be held by a user, and a first outermost virtual line which is a shortest line connecting the longitudinal center line and the first outermost part and a second outermost virtual line which is a shortest line connecting the longitudinal center line and the second outermost part are formed, and the first outermost virtual line is longer than the second outermost virtual line.

(Aspect 2)

The cleaning tool as defined in aspect 1, wherein the holding part includes a connection part connected to the grip part, a tip part on a side opposite to the connection part, and an extending part extending from the connection part toward the tip part, and wherein the first outermost part is provided in the extending part.

(Aspect 3)

The cleaning tool as defined in aspect 1 or 2, wherein the first outermost part is formed at a point bisecting a length of the extending part in the longitudinal direction.

(Aspect 4)

The cleaning tool as defined in any one of aspects 1 to 3, wherein the extending part has a curved shape projecting most at the first outermost part.

(Aspect 5)

The cleaning tool as defined in any one of aspects 1 to 4, wherein the projection includes a first projection formed on the tip part side of the holding part, and a second projection formed on the connection part side of the holding part.

(Aspect 6)

The cleaning tool as defined in aspect 5, wherein the second outermost part is formed in the first projection.

(Aspect 7)

The cleaning tool as defined in any one of aspects 1 to 6, wherein the cleaning sheet includes a contact sheet which contacts an object to be cleaned when cleaning the object, a holding sheet which is superposed on the contact sheet, and a bonded part by which the contact sheet and the holding sheet are bonded to form the insertion part.

(Aspect 8)

The cleaning tool as defined in aspect 7, wherein:

the cleaning tool has an inserting direction parallel to the longitudinal direction and a pulling-out direction opposite to the inserting direction, and the projection includes an inserting side region on a front side in the inserting direction, a pulling-out side region on a front side in the pulling-out direction, and an intermediate region between the inserting side region and the pulling-out side region, the projection has an insertion starting point at which the inserting side region first gets into contact with the bonded part when the holder is inserted into the insertion part; an insertion end point at which the contact of the inserting side region with the bonded part terminates when the holder is inserted into the insertion part; a first projection virtual line connecting the insertion starting point and the insertion end point; a second projection virtual line parallel to the inserting direction and passing through the insertion starting point; a first angle made by the first projection virtual line and the second projection virtual line; a pulling-out starting point at which the pulling-out side region first gets into contact with the bonded part when the holder is pulled out of the insertion part; a pulling-out end point at which the contact of the pulling-out side region with the bonded part terminates when the holder is pulled out of the insertion part; a third projection virtual line connecting the pulling-out starting point and the pulling-out end point; a fourth projection virtual line parallel to the pulling-out direction and passing through the pulling-out starting point; and a second angle made by the third projection virtual line and the fourth projection virtual line, and the first angle is smaller than the second angle.

(Aspect 9)

The cleaning tool as defined in any one of aspects 1 to 8, wherein a part of the cleaning sheet corresponding to the extending part is thicker than a part of the cleaning sheet corresponding to the connection part in a thickness direction of the cleaning sheet when the holder is inserted into the insertion part and holds the cleaning sheet.

(Aspect 10)

The cleaning tool as defined in aspect 9, wherein the part of the cleaning sheet corresponding to the extending part is thicker than a part of the cleaning sheet corresponding to the tip part in the thickness direction of the cleaning sheet when the holder is inserted into the insertion part and holds the cleaning sheet.

(Aspect 11)

The cleaning tool as defined in aspect 9 or 10, wherein:

the insertion part includes an opening into which the holding part is inserted, and an engagement part which has an internal space communicating with the opening and engages with the extending part, and a cross-sectional area of the internal space of the engagement part is larger than a cross-sectional area of the opening in a direction perpendicular to the inserting direction when the holder is inserted into the insertion part and holds the cleaning sheet.

(Aspect 12)

The cleaning tool as defined in aspect 11, wherein the engagement part has a larger amount of displacement than the opening in the thickness direction of the cleaning sheet.

(Aspect 13)

The cleaning tool as defined in aspect 11 or 12, wherein:

the opening is formed by bonding the holding sheet to the contact sheet at positions spaced a prescribed distance in a direction parallel to the longitudinal direction of the cleaning sheet, and the engagement part is formed by bonding the holding sheet to the contact sheet at positions spaced a longer distance than said prescribed distance in a direction parallel to the longitudinal direction of the cleaning sheet.

(Aspect 14)

The cleaning tool as defined in any one of aspects 1 to 13, wherein the extending part comprises two elongate members, and the two elongate members are connected to each other at the connection part.

(Aspect 15)

The cleaning tool as defined in aspect 14, wherein:

each of the elongate members comprises two elastically deformable elastic members, and the two elastic members are connected to each other at the connection part side and the tip part side, and are spaced apart from each other in an intermediate region between the connection part and the tip part in the thickness direction when the holder is inserted into the insertion part and holds the cleaning sheet.

(Aspect 16)

The cleaning tool as defined in aspect 15, wherein the intermediate region includes an intermediate portion located at an equal distance from the connection part and the tip part.

(Aspect 17)

The cleaning tool as defined in aspect 15 or 16, wherein distances between the two elastic members in the thickness direction and in a direction crossing the thickness direction vary in the intermediate region by elastic deformation of the two elastic members.

(Aspect 18)

The cleaning tool as defined in aspect 17, wherein a maximum distance in the thickness direction between the two elastic members in a state that no external force is applied is 250% or more of a minimum distance in the thickness direction between the two elastic members deformed by an external force.

(Aspect 19)

The cleaning tool as defined in any one of aspects 1 to 18, wherein:

the cleaning sheet has strips which are formed by a sheet-like member and contiguous to the insertion part and extend in the transverse direction, the insertion part includes a first insertion region formed by a sheet-like member and a second insertion region formed by a sheet-like member, the holding part in the holder has a tension applying part which applies prescribed tension to the second insertion region of the cleaning sheet, and when the holding part of the holder is inserted into the insertion part of the cleaning sheet, the tension applying part of the holding part applies tension to the second insertion region of the cleaning sheet so that the second insertion region forms a tension part, and the strips extending in the transverse direction in the tension part are moved in a direction toward the first insertion region.

(Aspect 20)

The cleaning tool as defined in aspect 19, wherein the tension applying part includes a first tension applying part which applies tension to the first insertion region of the cleaning sheet and a second tension applying part which applies tension to the second insertion region of the cleaning sheet.

(Aspect 21)

The cleaning tool as defined in aspect 19 or 20, wherein the second tension applying part is disposed inward of the first tension applying part in the transverse direction.

(Aspect 22)

The cleaning tool as defined in any one of aspects 19 to 21, wherein the tension part is formed from the second tension applying part to the first tension applying part.

The invention claimed is:

1. A cleaning tool, having a cleaning sheet and a holder for holding the cleaning sheet, wherein:

the cleaning tool has a longitudinal direction in which the holder is inserted into the cleaning sheet; a transverse direction crossing the longitudinal direction; a transverse direction center point which is a center point on the cleaning tool in the transverse direction; a longitudinal center line which is a line passing through the transverse direction center point in parallel to the longitudinal direction; an outside direction which is a direction away from the transverse direction center point on the cleaning tool; and an inside direction which is a direction toward the transverse direction center point on the cleaning tool, the cleaning sheet has an insertion part into which the holder is inserted, the holder includes a holding part having a pair of extending parts which is inserted into the insertion part of the cleaning sheet, a first outermost part of the holding part which projects most in the outside direction in the transverse direction, a projection which is formed in the outside direction in the holding part, a second outermost part of the projection which projects most in the outside direction in the transverse direction, and a grip part which is connected to the holding part and designed to be held by a user, and a first outermost virtual line which is a shortest line connecting the longitudinal center line and the first outermost part and a second outermost virtual line which is a shortest line connecting the longitudinal center line and the second outermost part are formed, and the first outermost virtual line is longer than the second outermost virtual line.

2. The cleaning tool as defined in claim 1, wherein the holding part includes a connection part connected to the grip part, a tip part on a side opposite to the connection part, and an extending part extending from the connection part toward the tip part, and wherein the first outermost part is provided in the extending part.

3. The cleaning tool as defined in claim 2, wherein the first outermost part is formed at a point bisecting a length of the extending part in the longitudinal direction.

4. The cleaning tool as defined in claim 2, wherein the extending part has a curved shape projecting most at the first outermost part.

5. The cleaning tool as defined in claim 2, wherein the projection includes a first projection formed on a side of the tip part of the holding part, and a second projection formed on a side of the connection part of the holding part.

6. The cleaning tool as defined in claim 5, wherein the second outermost part is formed in the first projection.

7. The cleaning tool as defined in claim 2, wherein a part of the cleaning sheet corresponding to the extending part is thicker than a part of the cleaning sheet corresponding to the connection part in a thickness direction of the cleaning sheet when the holder is inserted into the insertion part and holds the cleaning sheet.

8. The cleaning tool as defined in claim 7, wherein the part of the cleaning sheet corresponding to the extending part is thicker than a part of the cleaning sheet corresponding to the tip part in the thickness direction of the cleaning sheet when the holder is inserted into the insertion part and holds the cleaning sheet.

9. The cleaning tool as defined in claim 7, wherein:

the insertion part includes an opening into which the holding part is inserted, and an engagement part which has an internal space communicating with the opening and engages with the extending part, and a cross-sectional area of the internal space of the engagement part is larger than a cross-sectional area of the opening in a direction perpendicular to the inserting direction when the holder is inserted into the insertion part and holds the cleaning sheet.

10. The cleaning tool as defined in claim 9, wherein the engagement part has a larger amount of displacement than the opening in the thickness direction of the cleaning sheet.

11. The cleaning tool as defined in claim 9, wherein:

the opening is formed by bonding the holding sheet to the contact sheet at positions spaced a prescribed distance in a direction parallel to the longitudinal direction of the cleaning sheet, and the engagement part is formed by bonding the holding sheet to the contact sheet at positions spaced a longer distance than said prescribed distance in a direction parallel to the longitudinal direction of the cleaning sheet.

12. The cleaning tool as defined in claim 2, wherein the extending part comprises two elongate members, and the two elongate members are connected to each other at the connection part.

13. The cleaning tool as defined in claim 12, wherein:

each of the elongate members comprises two elastically deformable elastic members, and the two elastic members are connected to each other at a side of the connection part and a side of the tip part, and are spaced apart from each other in an intermediate region between the connection part and the tip part in the thickness direction when the holder is inserted into the insertion part and holds the cleaning sheet.

14. The cleaning tool as defined in claim 13, wherein the intermediate region includes an intermediate portion located at an equal distance from the connection part and the tip part.

15. The cleaning tool as defined in claim 13, wherein distances between the two elastic members in the thickness direction and in a direction crossing the thickness direction vary in the intermediate region by elastic deformation of the two elastic members.

16. The cleaning tool as defined in claim 15, wherein a maximum distance in the thickness direction between the two elastic members in a state that no external force is applied is 250% or more of a minimum distance in the thickness direction between the two elastic members deformed by an external force.

17. The cleaning tool as defined in claim 1, wherein the cleaning sheet includes a contact sheet which contacts an object to be cleaned when cleaning the object, a holding sheet which is superposed on the contact sheet, and a bonded part by which the contact sheet and the holding sheet are bonded to form the insertion part.

18. The cleaning tool as defined in claim 17, wherein:

the cleaning tool has an inserting direction parallel to the longitudinal direction and a pulling-out direction opposite to the inserting direction, and the projection includes an inserting side region on a front side in the inserting direction, a pulling-out side region on a front side in the pulling-out direction, and an intermediate region between the inserting side region and the pulling-out side region, the projection has an insertion starting point at which the inserting side region first gets into contact with the bonded part when the holder is inserted into the insertion part;

an insertion end point at which the contact of the inserting side region with the bonded part terminates when the holder is inserted into the insertion part;

a first projection virtual line connecting the insertion starting point and the insertion end point;

a second projection virtual line parallel to the inserting direction and passing through the insertion starting point;

a first angle made by the first projection virtual line and the second projection virtual line; a pulling-out starting point at which the pulling-out side region first gets into contact with the bonded part when the holder is pulled out of the insertion part;

a pulling-out end point at which the contact of the pulling-out side region with the bonded part terminates when the holder is pulled out of the insertion part;

a third projection virtual line connecting the pulling-out starting point and the pulling-out end point;

a fourth projection virtual line parallel to the pulling-out direction and passing through the pulling-out starting point; and a second angle made by the third projection virtual line and the fourth projection virtual line, and the first angle is smaller than the second angle.

19. The cleaning tool as defined in claim 1, wherein:

the cleaning sheet has strips which are formed by a sheet-like member and contiguous to the insertion part and extend in the transverse direction, the insertion part includes a first insertion region formed by a sheet-like member and a second insertion region formed by a sheet-like member, the holding part in the holder has a tension applying part which applies prescribed tension to the second insertion region of the cleaning sheet, and when the holding part of the holder is inserted into the insertion part of the cleaning sheet, the tension applying part of the holding part applies tension to the second insertion region of the cleaning sheet so that the second insertion region forms a tension part, and the strips extending in the transverse direction in the tension part are moved in a direction toward the first insertion region.

20. The cleaning tool as defined in claim 19, wherein the tension applying part includes a first tension applying part which applies tension to the first insertion region of the cleaning sheet and a second tension applying part which applies tension to the tension part defined by the second insertion region of the cleaning sheet.

21. The cleaning tool as defined in claim 20, wherein the second tension applying part is disposed inward of the first tension applying part in the transverse direction.

22. The cleaning tool as defined in claim 20, wherein the tension part is formed from the second tension applying part to the first tension applying part.

* * * * *